US007789211B2

(12) United States Patent
Uemizo et al.

(10) Patent No.: US 7,789,211 B2
(45) Date of Patent: Sep. 7, 2010

(54) DEVICE FOR VALIDATING VALUABLE PAPERS

(75) Inventors: Yoshiaki Uemizo, Kanagawa (JP); Katsutoshi Okawa, Kanagawa (JP); Hisashi Takehara, Kanagawa (JP)

(73) Assignee: Japan Cash Machines Co., Ltd., Osaka (JP)

( * ) Notice: Subject to any disclaimer, the term of this patent is extended or adjusted under 35 U.S.C. 154(b) by 170 days.

(21) Appl. No.: 11/813,673

(22) PCT Filed: Jan. 12, 2005

(86) PCT No.: PCT/JP2005/000253

§ 371 (c)(1),
(2), (4) Date: Jul. 11, 2007

(87) PCT Pub. No.: WO2006/075365

PCT Pub. Date: Jul. 20, 2006

(65) Prior Publication Data

US 2008/0128240 A1 Jun. 5, 2008

(51) Int. Cl.
*G07F 7/04* (2006.01)

(52) U.S. Cl. ..... 194/206; 194/207

(58) Field of Classification Search ..... 194/206, 194/207; 209/534; 242/528; 271/176, 216
See application file for complete search history.

(56) References Cited

U.S. PATENT DOCUMENTS

| | | | | |
|---|---|---|---|---|
| 5,222,584 | A * | 6/1993 | Zouzoulas | 194/207 |
| 5,495,929 | A * | 3/1996 | Batalianets et al. | 194/207 |
| 6,234,475 | B1 * | 5/2001 | Weigel et al. | 271/303 |
| 7,051,926 | B2 * | 5/2006 | Saltsov et al. | 235/379 |
| 2001/0022258 | A1 * | 9/2001 | Satou et al. | 194/206 |
| 2001/0055946 | A1 * | 12/2001 | Cost | 453/40 |
| 2003/0116400 | A1 * | 6/2003 | Saltsov et al. | 194/207 |
| 2004/0069591 | A1 * | 4/2004 | Ito | 194/206 |

FOREIGN PATENT DOCUMENTS

| | | |
|---|---|---|
| DE | 2723078 | 12/1977 |
| JP | 55-9251 | 1/1980 |
| JP | 9190559 | 7/1997 |
| JP | 9267947 A | 10/1997 |
| JP | 11031250 | 2/1999 |
| JP | 2003-288630 | 10/2003 |

* cited by examiner

*Primary Examiner*—Jeffrey A Shapiro
(74) *Attorney, Agent, or Firm*—Bachman & LaPointe, P.C.

(57) ABSTRACT

A conveying device 2 in a device for validating valuable papers, comprises a rotor arrangement 5 rotatably mounted in a casing 1, a drive device 12 for rotating rotor arrangement 5, and a roller arrangement 11 disposed around and in contact to an outer circumferential surface of rotor arrangement 5. A bill 10 inserted from an inlet 8 of casing 1 is grasped between rotor arrangement 5 and roller arrangement 11 to wind up the whole length of bill 10 around rotating rotor arrangement 5 so that bill 10 can reliably be transported with rotation of conveying device 2 while preventing slippage of bill 10 on rotor arrangement 5. Also, bill 10 can be rotated together with rotor arrangement 5 one revolution or more to positively prevent unauthorized extraction of bill 10 by means of any extraction tool. When a sensor 3 detects physical property of bill 10 and a control device 4 considers bill 10 to be genuine in view of the detected physical property of bill 10, the device separates bill 10 from rotor arrangements 5 to discharge it through an outlet 9.

35 Claims, 17 Drawing Sheets

DEVICE FOR VALIDATING VALUABLE PAPERS

BACKGROUND OF THE INVENTION

This invention relates to a device for validating valuable papers, in particular, of the type capable of discriminating authenticity of bills with high accuracy and also preventing unauthorized extraction of a bill out of the device.

As shown in FIGS. 25 and 26, a typical prior art bill validating device comprises a casement 71 having an inlet 78 and an outlet 79, a conveyer device 72 for transporting a bill 80 inserted from inlet 78 to outlet 79, a sensor 73 for detecting a physical property such as an optical or magnetic feature of bill 80 transported by conveyer device 72 to produce a detection signal, and a control device 74 for determining whether bill 80 is genuine or not in view of detection signal from sensor 73 to control operation of convey device 72. Casement 71 comprises a lower shell 76 and an upper shell 77 rotatably attached to lower shell 76. Conveyer device 72 comprises a motor 91, a drive gear 92 mounted on an output shaft of motor 91, a first gear 93 in engagement with drive gear 92, a second gear 94 meshed with first gear 93, a main drive pulley 95 driven by second gear 94, and a belt 97 wound around main drive pulley 95 and a plurality of follower pulleys 96 for transporting bill 80 along a guide passageway 70. Pinch rollers 83 are disposed opposite to each of main drive and follower pulleys 95 and 96 to urge bill 80 toward pulleys 95 and 96. Although not shown, but motor 91 comprises a rotary encoder for producing pulse signals generated in synchronization with rotation of motor 91, and a pulse sensor detects and forwards the pulse signals to control device 74. Sensor 73 includes a magnetic sensor such as magnetic head for detecting magnetic pattern by a ferrous element in ink printed on bill 80 or a photo-coupler for detecting light reflected on or penetrating through bill 80. Control device 74 controls operation of conveyer device 72 to transport and discharge bill 80 considered genuine through outlet 79, and stow it into a storage device or stacker mounted below bill validating device. When control device 73 considers bill 80 not to be genuine, it makes conveyer device 72 to drive in the adverse direction to return bill 80 to inlet 78.

As shown in FIG. 25, the bill validating device comprises an anti-pull back device for preventing improper extraction of bill 80 by means of a pull or extraction tool such as a string or tape connected to bill 80 transported toward stacker. Such anti-pull back devices are shown in for example the following Patent Documents 1 and 2. As illustrated in FIG. 25, the anti-pull back device comprises a winder 90 rotatably mounted on a lower shell 76 on guide passageway 70, and a drive motor not shown for rotating winder 90 which has an axial slit 98 for passing therethrough bill 80 transported along guide passageway 70. Control device 74 activates drive motor to rotate winder 90 after bill has passed through slit 98 of winder 90 to wind up any pull or extraction tool connected to bill 80 around winder 90 for prevention of improper bill extraction.

However, such an anti-pull back device is disadvantageous because it has to be separately assembled and then mounted in the bill validating device in addition to conveyer device 72, thereby leading to increase in number of involved parts, rise in cost for manufacture and heavier unit of the device as well as longer passageway of bill and larger size of the device. Also, in the prior art bill validating device shown in FIGS. 25 and 26, when control device 74 cannot correctly detect moving genuine bill 80 for example because of malfunction of sensor 73, the device inconveniently has to return bill 80 to inlet 78 once by adverse rotation of conveyer device 72, and then again transport it in the forward direction for reexamination of bill's physical property through sensor 73. This undesirably extends the examination time of bill 80, and also there is a risk that a user may accidentally pull out bill 80 returned to inlet 78 before resending bill 80 inward.

A bill validator exhibited in the following Patent Document 3, has a carrier which comprises drive rollers rotatably mounted in a case, a drive device for rotating drive rollers and a plurality of pinch rollers for resiliently urging bill toward drive rollers. In this bill validator, when a bill is inserted into an inlet, a motor is driven to rotate pinch and drive rollers so that bill is sandwiched and transported between pinch and drive rollers along an arcuate passageway curved at an angle of approximately 90 degrees in case. A magnetic field generator attached along bill passageway produces an AC magnetic field in passageway so that a magnetic sensor can detect change in magnetic field upon passage of bill therethrough. This can eliminate a mechanism for urging bill toward magnetic sensor to exactly detect magnetic property of bill, and therefore, the device can fully validate even worn-out bills.

[Patent Document 1] Japanese Patent Disclosure No. 9-190559,

[Patent Document 2] Japanese Patent Disclosure No. 11-31250 and

[Patent Document 3] U.S. Pat. No. 5,495,929.

By the way, the devices shown in Japanese Patent Disclosure No. 9-190559 and Japanese Patent Disclosure No. 11-31250 unfavorably require a longer bill passageway for transporting bill and increased number of involved parts because they must transport a bill along linear bill passageway by means of convey belts and incorporate additional anti-pull back device on the way of bill passageway which requires separate validation and anti-pull back areas. In particular, when rotation of a conveyer motor is converted into linear motion by means of conveyer belts, the devices undesirably incur energy conversion loss from electric to kinetic energy. In another aspect, used conveyer belts might give rise to longitudinal elongation due to their own elasticity and inherent structure of spanning conveyer belts between pulleys and winding them around pulleys. Elongation of conveyer belts in contact to bill tends to at least partly reduce the grasping force of bill so as to cause jamming of bill on the way of transportation, fail transportation or hinder smooth transportation of bill. Unlike these, bill validating device shown in U.S. Pat. No. 5,495,929 cannot prevent unauthorized extraction of bill from inside of the device since it has a simplified bill passageway without anti-pull back device.

Accordingly, an object of the present invention is to provide a device for validating valuable papers which has a fused mechanism of conveying and anti-pull back functions while the device can be made in smaller size and lighter weight with less number of parts involved.

Another object of the present invention is to provide a device for validating valuable papers which comprises a rotator arrangement for producing a large grasping force of a bill during its transportation to reliably prevent jamming of bill without conveyer belts.

SUMMARY OF THE INVENTION

The device for validating valuable papers according to the present invention, comprises a casing (1) having an inlet (8) and an outlet (9), a conveying device (2) for transporting a valuable paper (10) inserted from inlet (8) to outlet (9), a sensor (3) for detecting physical property of paper (10) transported by conveying device (2) to produce detection signals, and a control device (4) for validating authenticity of paper (10) in view of detection signals from sensor (3) to control operation of conveying device (2). Conveying device (2) comprises a rotor arrangement (5) rotatably mounted in casing (1), a drive device (12) for rotating rotor arrangement (5), and a roller arrangement (11) located around rotor arrangement (5) in contact to an outer surface of rotor arrangement (5). When paper (10) is inserted into inlet (8), it is grasped between rotor arrangement (5) and roller arrangement (11) to wind up a whole length of paper (10) around outer surface of rotor arrangement (5). Then, paper (10) can smoothly and certainly be transported together with rotation of rotor arrangement (5) while preventing slippage of paper (10) on rotor arrangement (5). At this time, paper (10) is rotated integrally with rotor arrangement (5) at least one revolution to disable improperly pulling out paper (10) from inside through any extraction tool connected to paper (10). Sensor (3) detects a physical property of paper (10) to produce detection signals to control device (4) which serves to discharge paper (10) wound around rotor arrangement (5) from an outlet (9) when it considers paper (10) to be genuine.

The present invention can provide an inexpensive, lightweight and small-sized device capable of smoothly validating valuable papers during rotation of the paper while preventing unauthorized extraction of the paper.

DETAILED DESCRIPTION

The following is description with respect to FIGS. 1 to 24 on embodiments of the device for validating valuable papers according to the present invention applied to a bill validating device.

Figure 1:
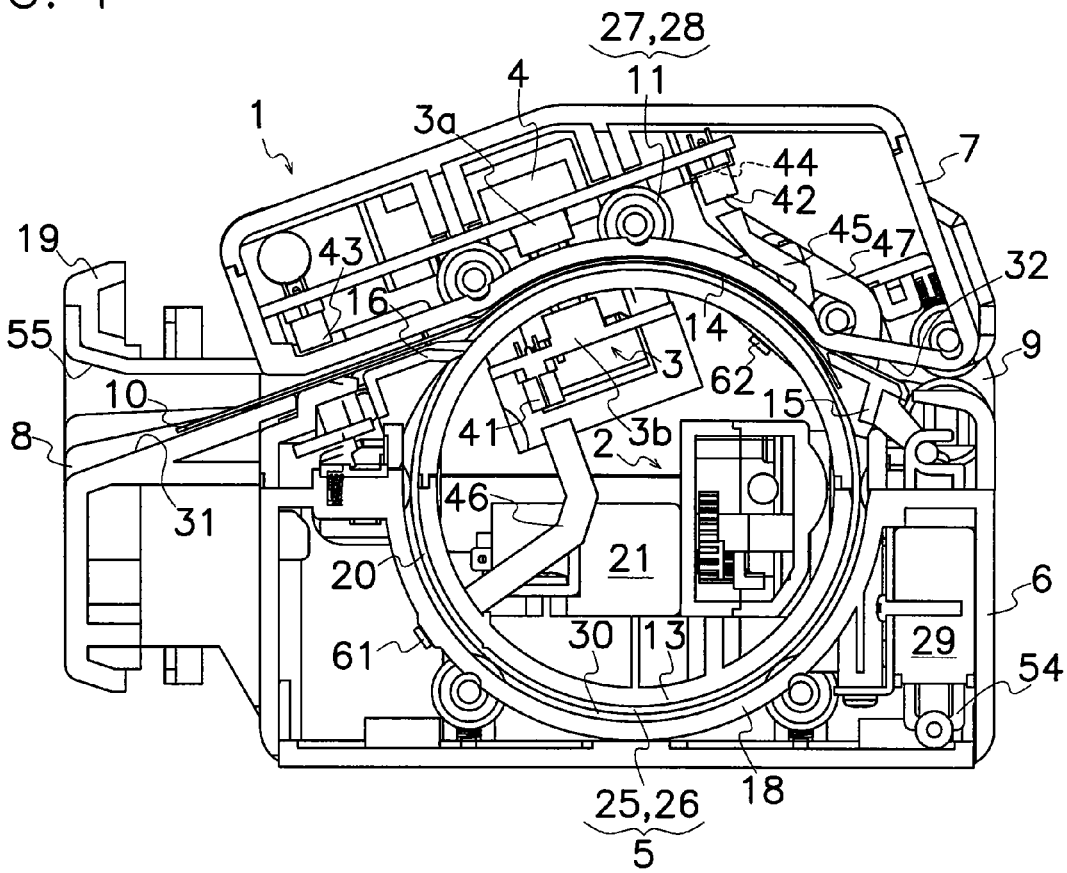
FIG. 1 A sectional view showing an embodiment of a bill validating device according to the present invention.
Figure 2:
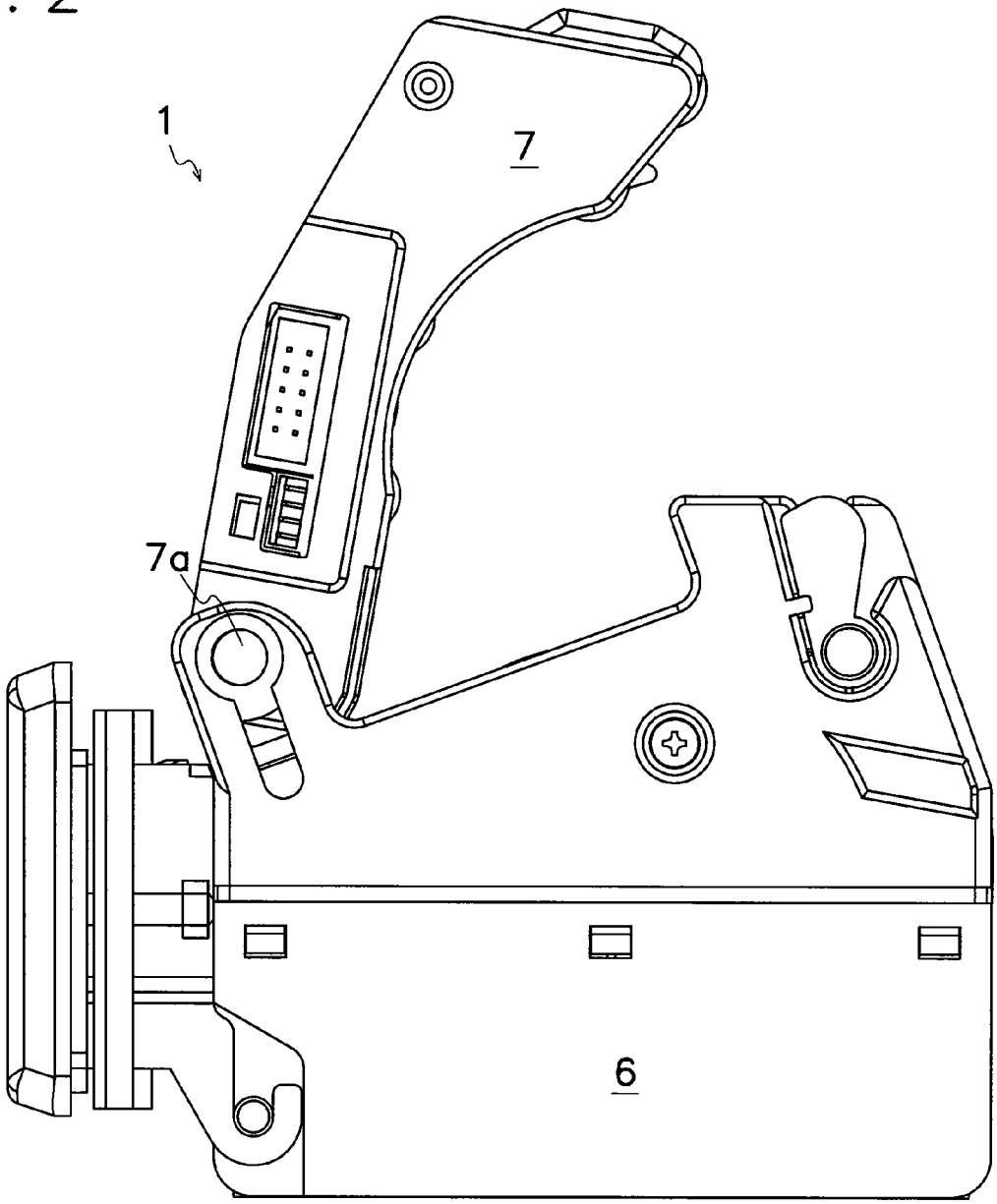
FIG. 2 A side elevation view of the bill validating device shown in FIG. 1 while removing an upper shell.
Figure 3:
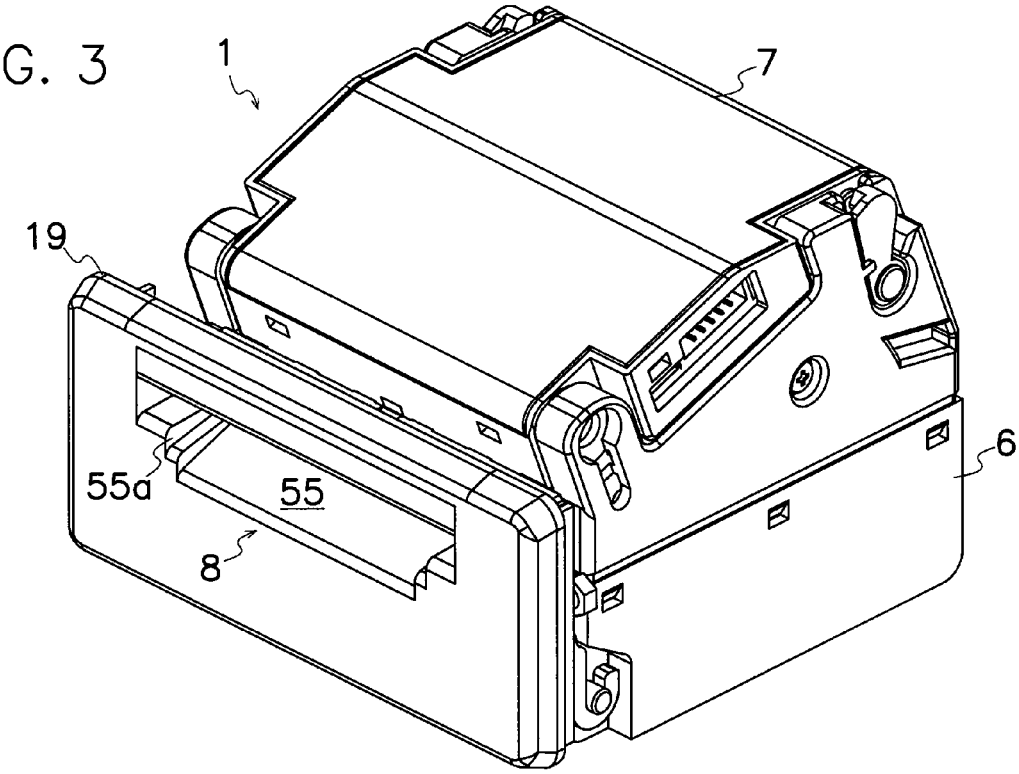
FIG. 3 A perspective view of the device shown in FIG. 1.

As shown in FIG. 1, the bill validating device according to the present invention, comprises a casing 1 having an inlet 8 and an outlet 9, a conveying device 2 for transporting a bill 10 inserted into inlet 8 to outlet 9, a validator sensor 3 for detecting physical features of bill 10 carried by conveying device 2 to produce detection signals, and a control device 4 for validating bill 10 based on or in view of detection signals from sensor 3 to control operation of conveying device 2. Casing 1 may be formed of synthetic resin or engineering plastics such as polyacetal (POM), acrylonitrile butadiene styrene (ABS), polyamide (PA) or polycarbonate (PC) resin, and, as shown in FIG. 2, comprises a lower shell 6 and an upper shell 7 rotatably attached to lower shell 6 around a shaft 7*a*. Also, as depicted in FIG. 3, attached to a front surface of lower shell 6 is a face plate 19 formed with an opening 55 in communication with inlet 8 formed in lower shell 6, and bilaterally symmetrical stepped guide walls 55*a* are formed on opposite side walls of opening 55 to centralize bill 10 inserted into opening 55 when opposite side edges of bill 10 are in contact to stepped guide walls 55*a*.

Figure 4:
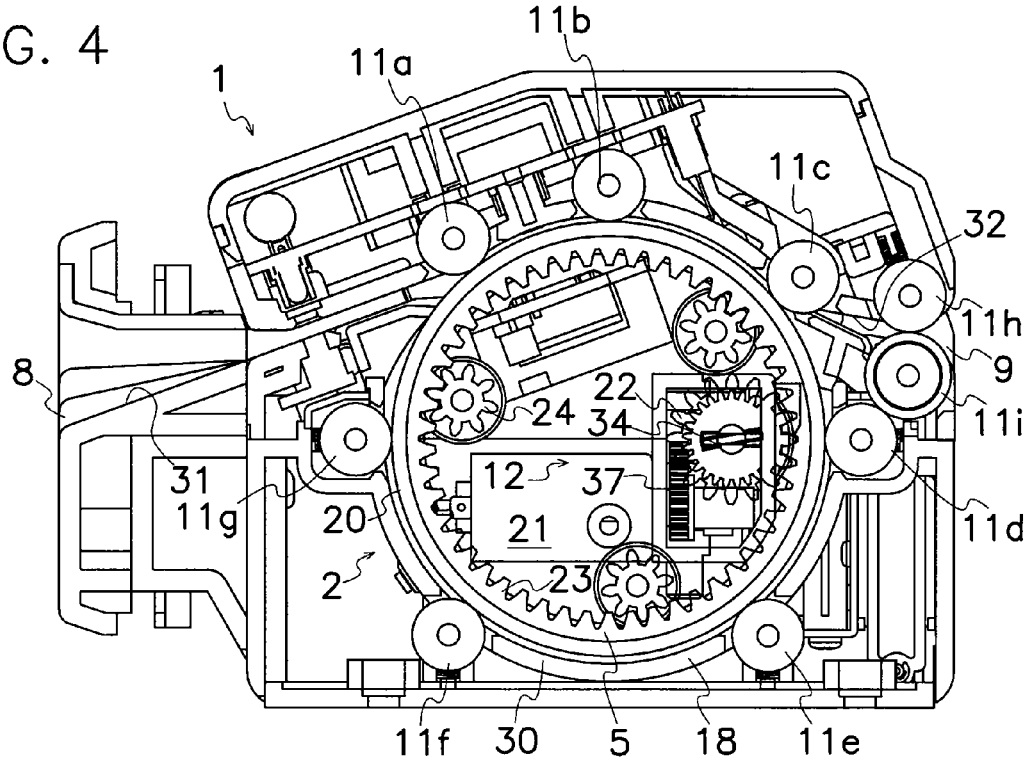
FIG. 4 Another sectional view of the device shown in FIG. 1.

As illustrated in FIG. 4, conveying device 2 comprises rotor arrangements 5 rotatably mounted in casing 1, a drive device 12 for rotating rotor arrangements 5, and roller arrangements 11 disposed around rotor arrangements 5 in contact to outer circumferential surface of rotor arrangements 5. Each outer circumferential surface of roller arrangements 11 is resiliently urged toward outer circumferential surface of rotor arrangements 5 by means of any springy or elastic member such as a spring mounted between lower or upper shell 6 or 7 and a bearing (not shown) for supporting roller arrangements 11. Each of roller arrangements 11 has at least three, for example, seven pinch rollers 11*a* to 11*g* positioned around and in contact to corresponding rotor arrangements 5. Formed in upper shell 7 is a guide surface 14 which has an arcuate shape partly complementary to a cylindrical outer surface of rotor arrangements 5 and in a radially spaced relation to rotor arrangements 5, and lower shell 6 comprises an arcuate member 18 in a radially spaced relation to rotor arrangements 5. Defined between rotor arrangements 5 and arcuate member 18 and between rotor arrangements 5 and guide surface 14 of upper shell 7 is an annular pathway 30 which provides a circular passage formed with substantially constant radius from a rotating center of rotor arrangements 5 independently from an entryway 31 extending from inlet 8 and an exit way 32 extending toward outlet 9 to transport bill 10 along entryway 31, annular pathway 30 and exit way 32. In this arrangement, rotor arrangements 5 can continuously be rotated at revolutions of desired number together with bill 10 for repetitive validation. Entryway 31 is communicated with annular pathway 30 in the tangential direction thereof from inlet 8, and exit way 32 is communicated with annular pathway 30 in the tangential direction thereof toward outlet 9 so that entryway 31 and exit way 32 form extended tangential lines from annular pathway 30. Bill 10 transported from entryway 31, runs a whole lap of annular pathway 30, and then is discharged through exit way 32 from outlet 9.

Figure 5:
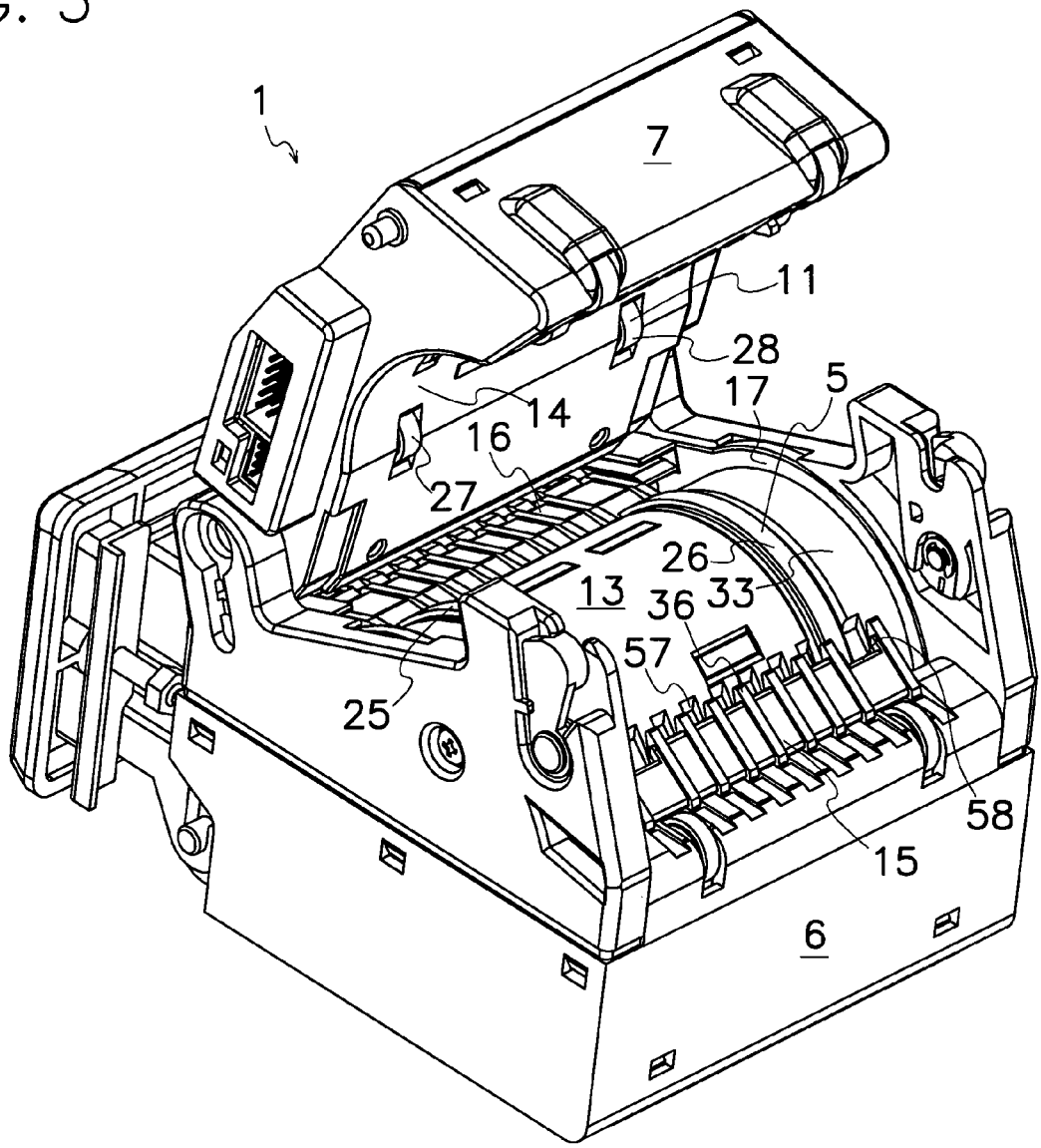
FIG. 5 Another perspective view of the device shown in FIG. 1 with an opened upper shell.
Figure 6:
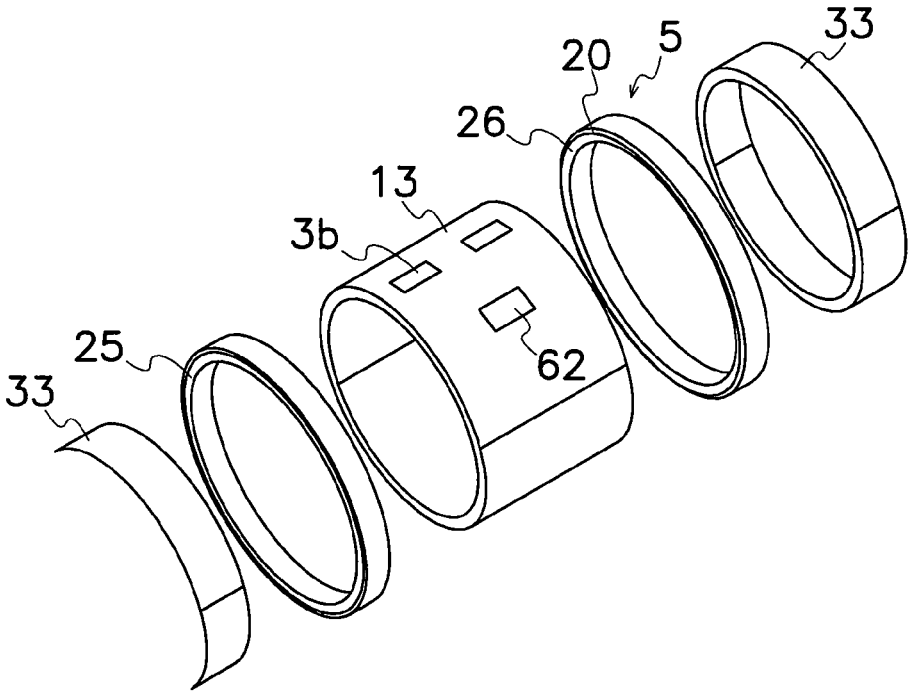
FIG. 6 An exploded perspective view of rotor arrangements and a drum.

As a whole outer circumferential length of rotor arrangements 5 is longer than a longitudinal length of bill 10, there is no overlap between opposite ends of bill 10 wound around rotor arrangement 5, and therefore, validator sensor 3 can detect physical properties along the whole length of bill 10. As shown in FIG. 5, a pair of circular side walls 17 are disposed inside casing 1 in a spaced relation to each other along the rotation axis of rotor arrangements 5 by a distance substantially equal to or slightly larger than width of bill 10 so that side walls 17 define side margins of annular pathway 30 and prevent widthwise or lateral movement of bill 10 between side walls 17 which serve to guide opposite ends of bill 10 transported on rotor arrangements 5 in the proper attitude. A drum 13 is provided in casing 1 adjacent to rotor arrangements 5 and has a diameter slightly smaller than that of rotor arrangement 5. In this embodiment, as shown in FIGS. 5 and 6, rotor arrangements 5 have first and second rotors 25 and 26 of the same diameter disposed in perpendicularly spaced relation to each other to the transported direction of bill 10. Roller arrangements 11 comprise a first set of pinch rollers 27 which include seven pinch rollers 11*a* to 11*g* each disposed around first rotor 25 and in contact to outer circumferential surface of first rotor 25, and a second set of pinch rollers 28 which include seven pinch rollers 11*a* to 11*g* each disposed around second rotor 26 and in contact to outer circumferential surface of second rotor 26. Drum 13 is secured on lower shell 6 between first and second rotors 25 and 26 synchronously rotated.

Each pair of first and second sets of pinch rollers 27 and 28 is disposed on a same shaft in spaced relation to each other by a constant distance. In the bill validating device shown in FIG. 4, each of first and second sets of pinch rollers 27 and 28 comprises first to seventh pinch rollers 11*a* to 11*g* pressed on respectively first and second rotors 25 and 26. Additional eighth and ninth pinch rollers 11*h* and 11*i* are disposed in the vicinity of outlet 9 to reliably discharge bill 10. However, the skilled in the art would change or modify the number and fixed positions of pinch rollers 11*a* to 11*i* as necessary. In this embodiment, bill 10 is carried along annular pathway 30 in the sandwiched condition between first and second sets of pinch rollers 27 and 28 and first and second rotors 25 and 26 to detect optical or magnetic property of bill 10 by validator sensor 3 with better accuracy than in prior art bill validating device utilizing conveyer belts.

As understood from FIGS. 5 and 6, located between first and second rotors 25 and 26 and side walls 17 respectively are side drums 33 which are formed of resin material of similar or same kind with substantially the same diameter as that of drum 13, and therefore, first and second rotors 25 and 26 are positioned between drum 13 and corresponding side drums 33. Side drums 33 are for example molded of plastic material integrally with circular side walls 17 and lower shell 6. While drum 13 may be formed of resin material of similar or same kind to that of casing 1, first and second rotors 25 and 26 are made of tough resin material such as polyacetal (POM) and polycarbonate (PC) resin, and first and second rotors 25 and 26 may preferably have an antiskid coating layer 20 on the outer circumferential surface. Coating layer 20 can be formed by bonding under pressure, securing, fusing, welding, applying a thin coating film of soft resin or elastic material such as elastomer or rubber or spraying liquid material thereof on outer circumferential surface of first and second rotors 25 and 26 to prevent slippage of bill 10 on rotors 25 and 26 during transportation. Otherwise, to improve antiskid property, a plurality of protrusions, dents, longitudinal or lateral grooves, knurling or indentation may be formed on outer surfaces of coating layer 20 or first and second rotors 25 and 26. Unlike prior art conveying device of belt type which produces larger elongation in conveyer belts in contact to bill, the present embodiment can convey bill 10 wound around and pressed on rotor arrangements 5 by roller arrangements 11 without elastic deformation of rotor 5 while bill 10 is strongly grasped between rotor arrangements 5 and roller arrangements 11. In other words, the device can positively carry even worn-out or creased or floppy bill from inlet 8 to outlet 9 while preventing jamming and slippage of bill 10 on the way.

Validation sensor 3 comprises a photo-coupler which has a single or plural light emitting diodes (LEDs) 3*a* and a single or plural light receiving transistors 3*b* for receiving light emitted from LEDs 3*a* and then reflected on or penetrating through bill 10 to detect optical features of rotating bill 10 wound around outer circumferential surfaces of first and second rotors 25 and 26. In case of plural LEDs 3*a* used, they are selected to emit lights of infrared ray, red and green colors. As shown in FIG. 1, LED 3*a* and light receiving transistor 3*b* are attached to respectively guide surface 14 of upper shell 7 and drum 13, however, these can be attached to the reverse positions. One of LED 3*a* and light receiving transistor 3*b* is attached to drum 13 secured to lower shell 6 and the other of LED 3*a* and light receiving transistor 3*b* is attached to guide surface 14 of upper shell 7 between rotatable first and second rotors 25 and 26 to detect physical property of bill 10 by validator sensor 3 while bill 10 is rotated together with first and second rotors 25 and 26. Without limitation of validator sensor 3 only to optical sensor such as photo-coupler, validator sensor 3 may comprise a magnetic sensor such as magnetic head for detecting magnetic property of bill in lieu of or in addition to optical sensor.

Figure 7:
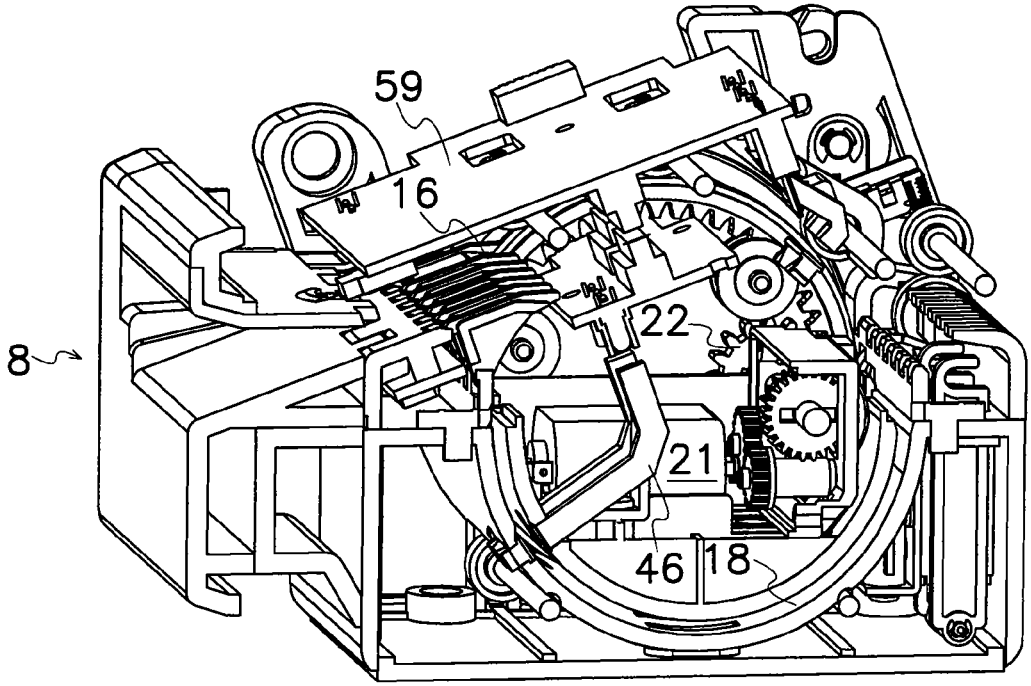
FIG. 7 A perspective view of the device shown in FIG. 1 while removing a part thereof.
Figure 8:
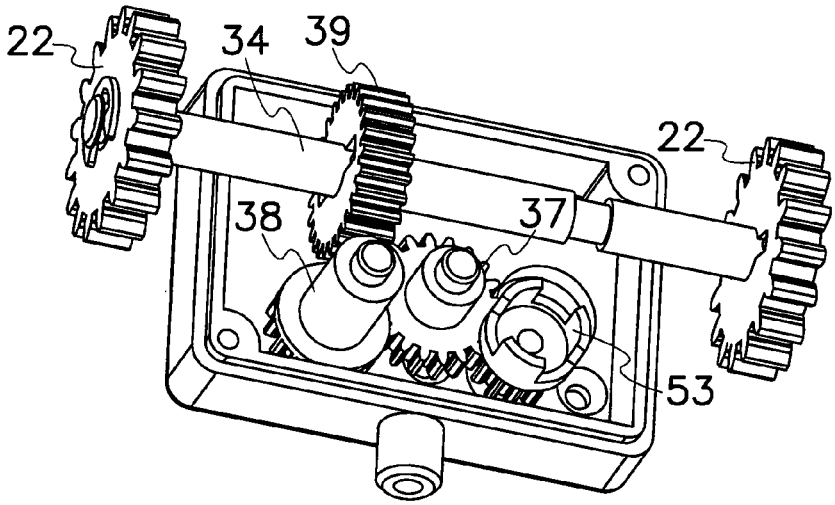
FIG. 8 A perspective view of pinions and their peripheral elements.
Figure 9:
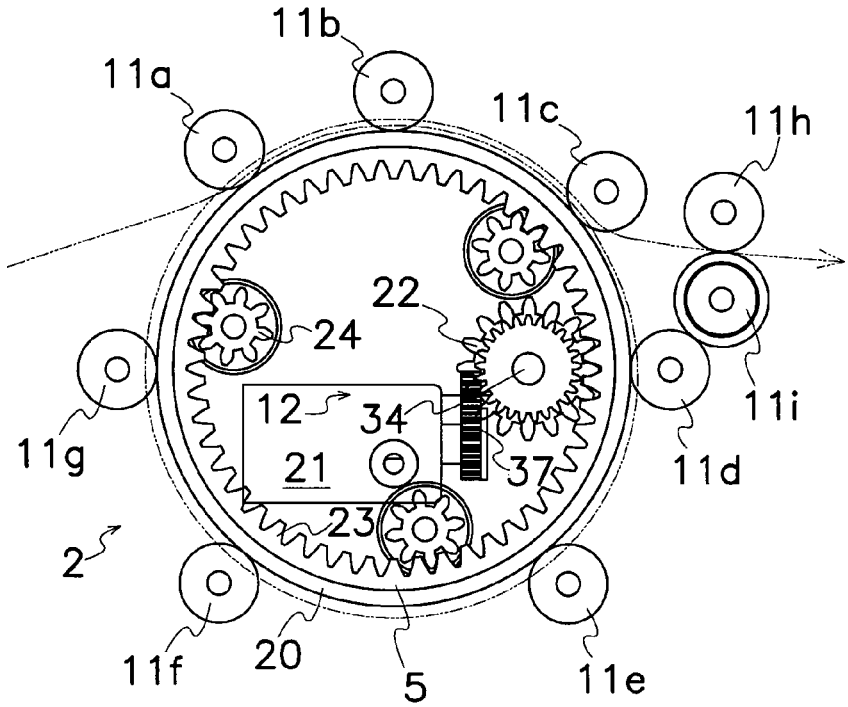
FIG. 9 A sectional view of a conveying device.

As shown in FIGS. 7 and 8, drive device 12 comprises a single motor 21, and a pair of pinions 22 rotatably mounted on a drive shaft 34 rotated by motor 21, and each of first and second rotors 25 and 26 has an internal gear 23 formed integrally with an inner circumferential surface of corresponding rotors 25, 26 and in engagement with each pinion 22. In other words, each pinion 22 is meshed with internal gear 23 formed on corresponding inner peripheral surface of first and second rotors 25 and 26 to rotate them at a same rotational rate in synchronization with each other by motor 21. Driving force from motor 21 is transmitted to pinions 22 and an intermediate gear 39 on a drive axis 34 through a drive gear 37 mounted on a rotation shaft of motor 21, a small gear 38 such as worm or bevel gear interlocked with drive gear 37 and intermediate gear 39 engaged with small gear 38 with large reduction ratio. FIG. 9 indicates a movement track by a dotted line of bill 10 transported from entryway 31 through annular pathway 30 to exit way 32. Intermediate gear 39 is mounted on drive axis 34 between a pair of pinions 22. A plurality of idle pinions 24 are positioned within first and second rotors 25 and 26 for engagement with internal gears 23 of first and second rotors 25 and 26 to rotatably support first and second rotors 25 and 26. Power transmission means incorporates drive gear 37, small gear 38, intermediate gear 39 and pinions 22 to transmit drive power to rotor arrangements 5, namely first and second rotors 25 and 26. Intermediate gear 39 is meshed with small gear 38 with large reduction ratio to provide a backstop. Thus, motor 21 can be rotated in the forward and reverse directions to smoothly rotate rotor arrangements 5 or roller arrangements 11 in the forward and reverse directions through the power transmission means. Adversely, even if any extraction tool such as strings connected to bill 10 is used to apply external force on rotor arrangements 5 or roller arrangements 11, intermediate gear 39 can absolutely prevent rotation of rotor arrangements 5 or roller arrangements 11.

Idle pinions 24 are rotatably mounted on one end of pinion shafts not shown whose the other end is fixed on an inner circumferential surface of drum 13 to support first or second rotor 25 or 26 through idle pinions 24. In other words, plural idle pinions 24 are engaged with internal gear 23 to transmit drive power and also to rotatably support first and second rotors 25 and 26 in position without any boss or hub. In this way, first and second rotors 25 and 26 can synchronously be rotated to grasp opposite side ends of bill 10 inserted into inlet 8 between first rotor 25 and first set of pinch rollers 27 and between second rotor 26 and second set of pinch rollers 28 so that bill 10 can be conveyed in the proper attitude and at even or equal transportation speed of both sides of bill 10 through entry way 31, annular pathway 30 and exit way 32 while certainly preventing jamming of bill 10. In another aspect, even if any liquid flows into inlet 8, it drops down along first and second rotors 25 and 26 or drum 13 to prevent inflow of liquid further inside. In the embodiment shown in FIG. 4, three idle pinions 24 support each of first and second rotors 25 and 26, and drive power from motor 21 is transmitted to first and second rotors 25 and 26 through pinions 22. It would be obvious to ordinary skilled that number and location of idle pinions 24 or pinion 22 may be changed as required. Drive device 12 may comprise an encoder gear 53 attached adjacent to drive gear 37 in addition to worm or bevel gear 38. A rotary encoder not shown attached to encoder gear 53 is rotated by motor 21 through drive gear 37 and encoder gear 53 to produce pulse signals in synchronization with the rotation.

Motor 21 and pinion 22 are disposed inside of first and second rotors 25 and 26 and drum 13. In the bill validating device shown in Patent Document 3, the drive device including motor must be mounted out of drive rollers because boss or hub and a drive shaft must be mounted within drive rollers to support drive rollers. Unlike this, the present embodiment can incorporate drive device 12 including motor 21 within drum 13 between first and second rotors 25 and 26 of rotor arrangements 5 rotated by internal gear 23 to improve package density and smaller footprint of the device. Also, without utilizing convey belts for transportation of bill 10, the device can shorten distance of bill conveyance and reduce number of parts for the driving system to manufacture conveying device 2 and bill validating device in smaller size and lighter weight through the easy assembling process.

Figure 10:
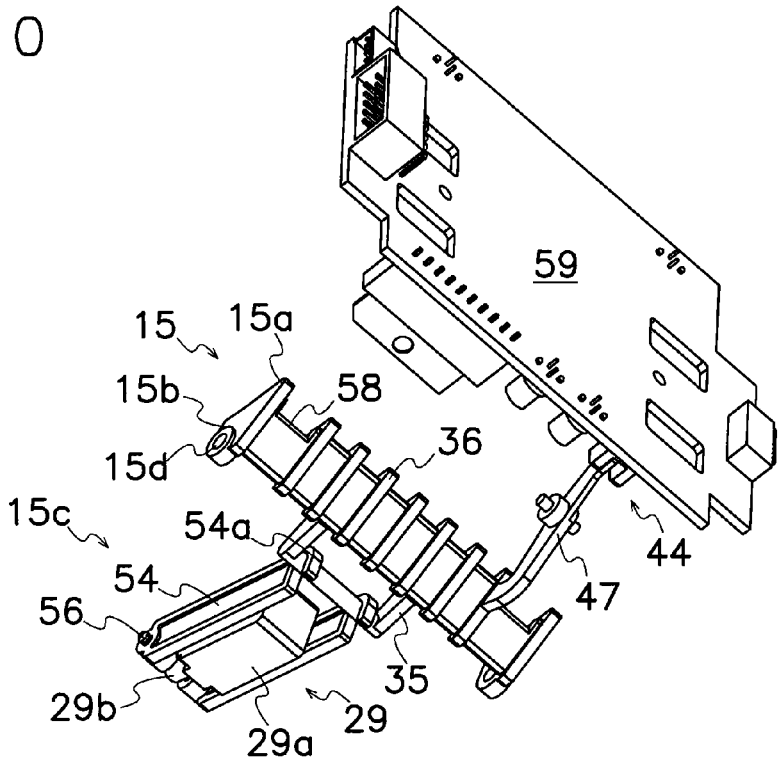
FIG. 10 A perspective view of an outlet deflector and its peripheral elements.

As shown in FIG. 1, conveying device 2 comprises outlet and return deflectors 15 and 16 each formed of resin material similar to that of casing 1 and disposed between circular side walls 17. Outlet deflector 15 is provided in the vicinity of exit way 32 outside of first and second rotors 25 and 26 for movement between the contact position wherein outlet deflector 15 is in contact to outer surfaces of drum 13 and side drums 33 and the separate position wherein outlet deflector 15 is away from drum 13 and side drums 33. Return deflector 16 is provided in the vicinity of entryway 31 outside of first and second rotors 25 and 26 for movement between the contact position wherein return deflector 16 is in contact to outer surfaces of drum 13 and side drums 33 and the separate position wherein return deflector 16 is away from drum 13 and side drums 33. As shown in FIG. 10, outlet deflector 15 has the thickness tapered from a rear end 15*b* and toward a front end 15*a* and the width substantially same as or slightly larger than that of bill 10. Outlet deflector 15 is pivotally connected to lower shell 16 around a shaft 15*d* provided at the rear end 15*b* of deflector 15 and rotatably mounted on lower shell 6, and front end 15*a* of outlet deflector 15 is movable between the contact position of FIG. 11 (*a*) wherein front end 15*a* is in contact to outer circumferential surfaces of drum 13 and side drums 33 to discharge bill 10 through outlet 9, and separate position of FIG. 11 (*b*) wherein front end 15*a* is away from outer circumferential surfaces of drum 13 and side drums 33 to pass bill 10 through outlet deflector 15 into annular pathway 30. An actuator 15*c* is provided to move outlet deflector 15 between the contact and separate positions.

Figure 11:
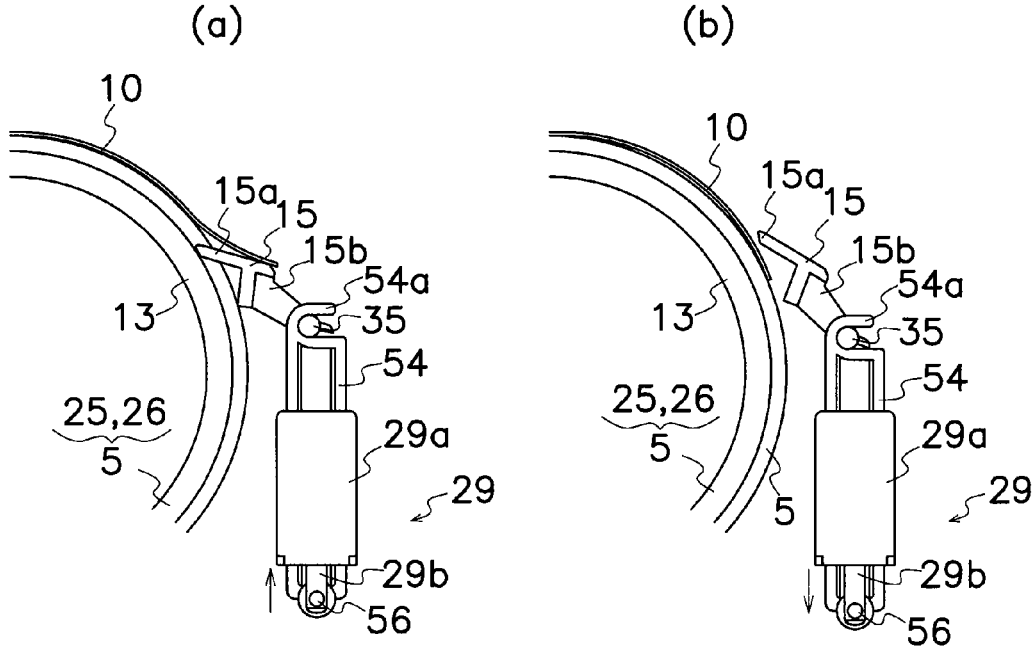
FIG. 11 Sectional views showing the outlet deflector in the contact and separate positions.

Actuator 15*c* comprises a pair of arms 54 in spaced relation to each other, a joint shaft 56 for connecting rear ends of arms 54, and a solenoid 29 disposed between arms 54. Solenoid 29 has a case body 29*a* provided with a solenoid coil not shown, and a plunger 29*b* movable toward and away from case body 29*a*, and a tip end of plunger 29*b* is pivotally connected to joint shaft 56. Arm 54 has a pair of hooks 54*a* which receive a clevis 35 formed in rear end 15*b* of outlet deflector 15. Solenoid 29 is usually operated to shift outlet deflector 15 in the separate position to pass bill 10 through outlet deflector 15, however, when bill 10 on rotor arrangements 5 is removed from rotor arrangements 5 and discharged through outlet 9, solenoid 29 is operated to temporarily shift outlet deflector 15 to the separate position. To this end, solenoid 29 has a spring not shown to usually urge outlet deflector 15 toward the separate position by means of elastic force of spring. When bill 10 is released through outlet 9, solenoid 29 is activated to move plunger 29*b* toward rotor arrangement 5 against elastic force of spring as shown in FIG. 11 (*a*) so that front end 15*a* of outlet deflector 15 is in contact to outer circumferential surfaces of drum 13 and side drums 33 to discharge bill 10 through outlet 9. Adversely, when bill 10 is rotated through annular pathway 30 with rotation of rotor arrangements 5, solenoid 29 is deactivated to move plunger 29*b* away from rotor arrangements 5 to the separate position by means of elastic force of the spring as shown in FIG. 11 (*b*) so that front end 15*a* of outlet deflector 15 is spaced from outer circumferential surfaces of drum 13 and side drums 33 not to cause outlet deflector 15 to intervene annular pathway 30. Otherwise, without spring, solenoid 29 may have a push-pull function of plunger 29*b* shifted in two directions so that plunger 29*b* may be shifted in either direction upon activation of solenoid 29 to shift outlet deflector 15 to the contact or separate position. When plunger 29*b* is moved upward toward case body 29*a* as seen in FIG. 11 (*a*), arms 54 are also moved upward, and front end 15*a* of deflector 15 is rotated around shaft 15*d* of rear end 15*b* to come into contact to outer circumferential surfaces of drum 13 and side drums 33 in the contact position. Adversely, when plunger 29*b* is moved downward away from case body 29*a* as seen in FIG. 11 (*b*), arms 54 are also moved downward together with joint shaft 56, and front end of deflector 15 is rotated around shaft 15*d* to go away from outer circumferential surfaces of drum 13 and side drums 33 to the separate position.

When outlet deflector 15 is in the separate position, bill 10 is rotated together with rotor arrangements 5 passing inside of outlet deflector 15, and adversely, when outlet deflector 15 is in the contact position, bill 10 is discharged along outlet deflector 15 through outlet 9. Shifting of outlet deflector 15 to the contact or separate position allows bill 10 to selectively rotate on rotor arrangements 5 or discharge through outlet 9. Actuator 15*c* is not limited only to solenoid 29, and may comprise other drive means such as motor to shift outlet deflector 15. As illustrated in FIG. 10, outlet deflector 15 may be formed with a plurality of ratchets 36 at intervals widthwise at tip end 15*a* of deflector 15, and as shown in FIG. 5, drum 13 and two side drums 33 have the outer circumferential surfaces formed with notches 57 of the shape complementary to that of ratchets 36 to receive them in notches 57. When outlet deflector 15 is in the separate position, tips of ratchets 36 are received in notches 57 and simultaneously tip end 15*a* of deflector 15 is in contact to outer circumferential surfaces of drum 13 and side drums 33. A pair of cutouts 58 are formed at tip end 15*a* of deflector 15 to avoid contact between tip end 15*a* of deflector 15 and outer circumferential surface or coating layer 20 of first and second rotors 25 and 26 so that tip end 15*a* of deflector 15 does not block rotation of first and second rotors 25 and 26.

Figure 12:
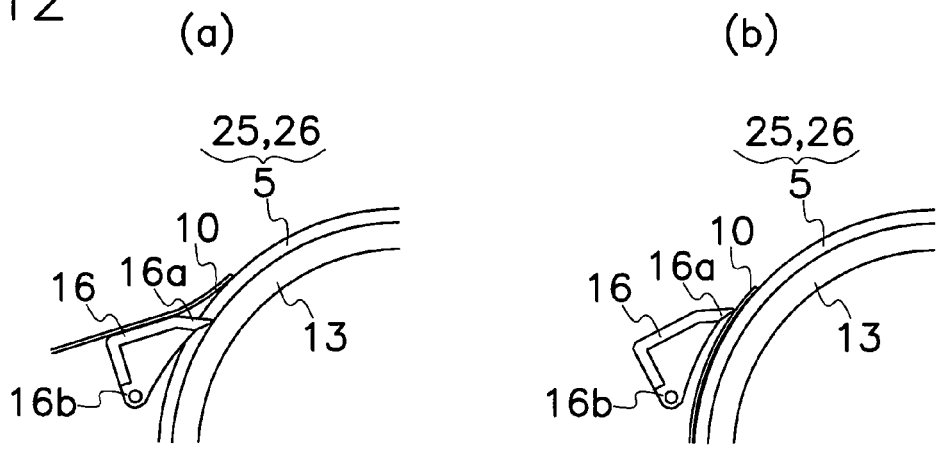
FIG. 12 Sectional views showing a return deflector moved upon passage of a bill.

As shown in FIG. 1, return deflector 16 in conveying device 2 is mounted in the vicinity of inlet 8 of casing 1 outside of first and second rotors 25 and 26. Return deflector 16 is formed into a similar shape to that of outlet deflector 15, and although not shown, has ratchets at the tip end 16*a* and notches are formed on outer circumferential surfaces of drum 13 and two side drums 33. As shown in FIG. 12 and similarly to outlet deflector 15, return deflector 16 is pivotally attached to lower shell 6 at rear end 16*b* to rotate return deflector 16 between the contact position wherein tip end 16*a* is in contact to outer circumferential surfaces of drum 13 and side drums 33 and the separate position wherein tip end 16*a* is away from drum 13 and side drums 33. However, return deflector 16 is different from outlet deflector 15 in that return deflector 16 is biased toward outer circumferential surfaces of drum 13 and side drums 33 by virtue of its own weight or elastic force of spring.

As shown in FIG. 12 (*a*), return deflector 16 is usually in the contact position wherein tip end 16*a* of deflector 16 is in contact to outer circumferential surfaces of drum 13 and side drums 33. When first and second rotors 25 and 26 are rotated in the clockwise direction of FIGS. 1 and 12 (*b*), bill 10 wound around first and second rotors 25 and 26 is rotated toward exit way 32 while bill 10 rotates together with rotor arrangements 5 overriding deflector 16 which is forcibly rotated outward by bill 10 as shown in FIG. 12 (*b*) against elastic force of spring or own weight of deflector 16 for urging deflector 16 toward rotor arrangements 5. At the time, deflector 16 rotates in the counterclockwise direction around a shaft provided at rear end 16*b* away from drum 13 and side drums 33 to allow bill 10 to travel inside of deflector 16. In another condition, bill 10 inserted into inlet 8 is moved over deflector 16 as shown in FIG. 12 (*a*) through entryway 21 to annular pathway 30. When first and second rotors 25 and 26 are rotated in the adverse direction to return bill to inlet 8, as shown in FIG. 12 (*a*), bill 10 wound around first and second rotors 25 and 26 is diverted along deflector 16 from rotors 25 and 26 to entryway 31 toward inlet 8.

Bill validating device comprises an inlet sensor 43 for detecting bill 10 inserted from inlet 8 to produce a detection signal to control device 4, a jam sensor 41 for detecting jamming of bill 10 in annular pathway 30 to produce a jamming signal to control device 4, a deflector sensor 44 for detecting movement of outlet deflector 15 to the contact position to produce a contact signal to control device 4, and an outlet sensor 42 for detecting discharge of bill 10 to produce a discharge signal to control device 4. Outlet sensor 42 has also an additional function to detect jamming of bill 10 after it has passed validator sensor 3. On the other hand, jam sensor 41 detects jamming of bill 10 through a reflector 16 after it has passed outlet sensor 42. Like validator sensor 3, each sensor 41, 43 and 44 comprises a photo-coupler of LED and light receiving transistor. As shown in FIG. 1, one and the other of LED and light receiving transistor are respectively attached to an inner side of guide surface 14 of upper shell 7 and lower shell 6 opposite to guide surface 14 in the vicinity of inlet 8 of casing 1.

Figure 13:
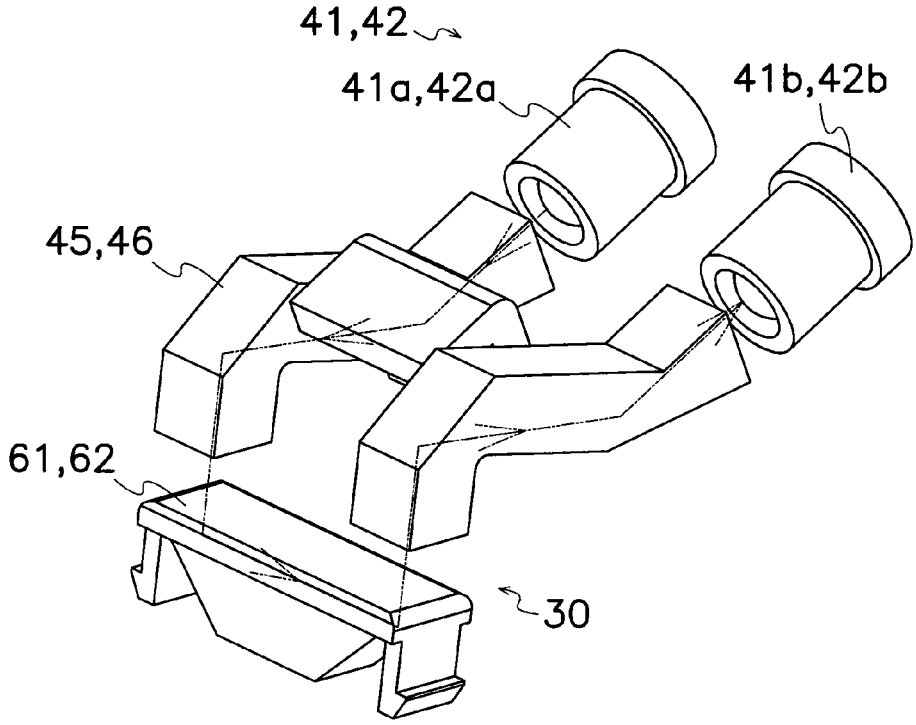
FIG. 13 A perspective view showing an outlet sensor and a jam sensor.

As seen in FIGS. 1 and 13, outlet sensor 42 comprises an LED 42*a* and a light receiving transistor 42*b* attached adjacent to each other in upper shell 7. LED 42*a* emits a light which enters an optical guide 45 formed of a transparent or light-permeable plastic material to irradiate light from optical guide 45 in annular pathway 30. Light irradiated in annular pathway 30 goes into a reflector 62 in drum 13, and then is reflected at a right angle twice in reflector 62 to deflect the moving direction of light at an angle 180 degrees. The light again goes across annular pathway 30, enters optical guide 45 and is received by light receiving transistor 42*b*. Bill 10 in annular pathway 30 blocks passage of light between optical guide 45 and reflector 62 to detect existence of bill 10 by light receiving transistor 42*b*. Jam sensor 41 comprises an LED 41*a* and a light receiving transistor 41*b* attached adjacent to each other in drum 13. In a similar manner to the structure of outlet sensor 42, light from LED 41*a* is emitted in annular pathway 30 through an optical guide 46, goes across annular pathway 30, is reflected at a right angle twice in reflector 61 and then passes in optical guide 46 to finally receive the light by light receiving transistor 41*b*.

Optical guides 45 and 46 are used to deploy LEDs 41*a* and 42*a* and light receiving transistors 41*b* and 42*b* at desired locations of casing 1 for greater flexibility in structural design so that plural sensors 3, 41, 42, 43 and 44 may be mounted on a single printed circuit board like validator sensor 3 and jam sensor 41. Optical guides 45 and 46 of jam and outlet sensors 41 and 42 may be deployed in an angularly spaced relation to each other by approximately 180 degrees along annular pathway 30 so that jam and outlet sensors 41 and 42 can detect presence or absence of bill 10 in annular pathway 30 after bill 10 has passed them along annular pathway 30 to confirm emergence of jamming or regular transportation of bill 10. Bill validating device according to this embodiment can convey bill 10 whose both sides are firmly grasped between first rotor 25 and first set of pinch rollers 27 and between second rotor 26 and second set of pinch rollers 28 to positively prevent jamming of bill 10, and therefore, jam sensor 41 may be omitted or another sensor such as validator sensor 3 may be substituted for jamming sensor 41 to detect jamming. Optical guides 45 and 46 may comprise other optical members for reflecting or refracting light from LED such as a reflector or prism. Also, in a similar way, reflectors 61 and 62 may comprise reflecting plates or prism.

As shown in FIG. 10, deflector sensor 44 has an LED and light receiving transistor mounted on a same printed circuit board 59 in upper shell 7 to detect movement of a lever 47 connecting tip end 15*a* of outlet deflector 15 to printed circuit board 59. One end of lever 47 is pivotally connected to circuit board 59 such that lever 47 is moved between LED and light receiving transistor of deflector sensor 44 to block light from LED when outlet deflector 15 is in the separate position away from drum 13 and side drums 33. Adversely, when outlet deflector 15 is in the contact position to drum 13 and side drums 33, lever 47 is away from between LED and light receiving transistor of deflector sensor 44 to allow light from LED to reach light receiving transistor. In this way, deflector sensor 44 detects un-obstruction of light from LED by lever 47 to produce a contact signal to control device 4 when deflector 15 is in the contact position. Otherwise, deflector sensor 44 may directly detect movement of outlet deflector 15 or directly or indirectly movement of plunger 29*b* of solenoid 29 as a solenoid sensor.

Figure 14:
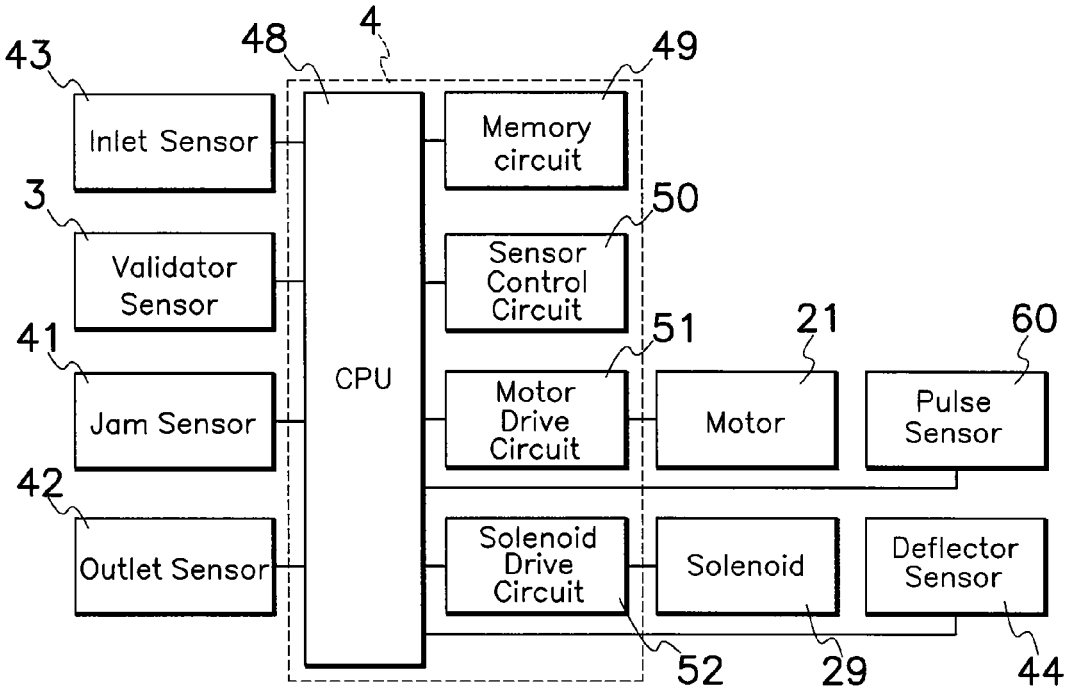
FIG. 14 An electric circuit diagram for electrically controlling the device.

Control device 4 in upper shell 7 of casing 1 comprises, as shown in FIG. 14, a central processing unit (a microcomputer or CPU) 48, a memory circuit 49 comprised of a RAM, ROM and $E^2$PROM (nonvolatile semiconductor memory), a sensor control circuit 50 for forwarding drive signals to inlet sensor 43, validator sensor 3, jam sensor 41, deflector sensor 44 and pulse sensor 60 and receiving detection signals from these sensors in accordance with output signals from CPU 48, a motor drive circuit 51 for receiving output signals from CPU 48 to supply drive signals to motor 21, and a solenoid driver 52 for receiving output signals from CPU 48 to supply drive signals to solenoid 29. CPU 48 controls operation of conveying device 2 and each sensor 3, 41, 42, 43 and 44 in accordance with operation program and control software stored in memory circuit 49 which also stores information such as data regarding genuine bills and identification of bill validating device so that CPU 48 can compare physical property detected of bill 10 by validator sensor 3 with stored data on genuine bills in the identified bill validating device. Pulse sensor 60 detects pulse signals generated from rotary encoder rotated by motor 21, and CPU 48 counts pulse signals from pulse sensor 60 to determine a moved position of bill 10 in annular pathway 30 in accordance with the number of counted pulse signals or rotations of motor 21. The technique for determining moved position of bill by means of rotary encoder and pulse sensor is known in prior art bill validating devices, and description thereon is omitted herein.

Although not shown, but bill validating device may comprise a stacker or storage unit attached to a back surface of casing 1 to stow bills 10 discharged from outlet 9. Stacker has a chamber defined in communication with annular pathway 30 of bill validating device to receive bills 10 considered genuine by bill validating device in order.

Figure 15:
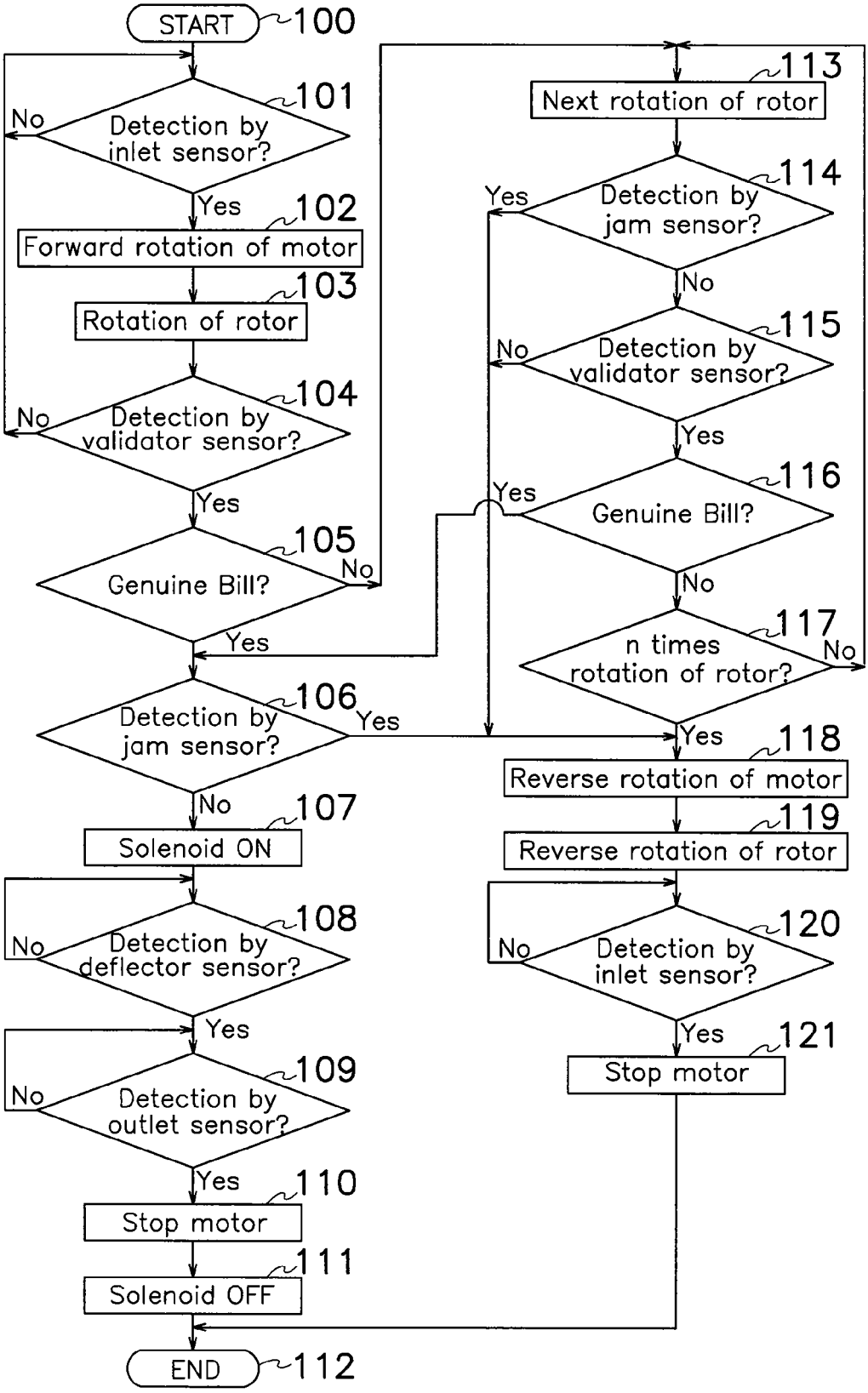
FIG. 15 A flow chart showing an operational sequence of the device shown in FIG. 1.
Figure 16:
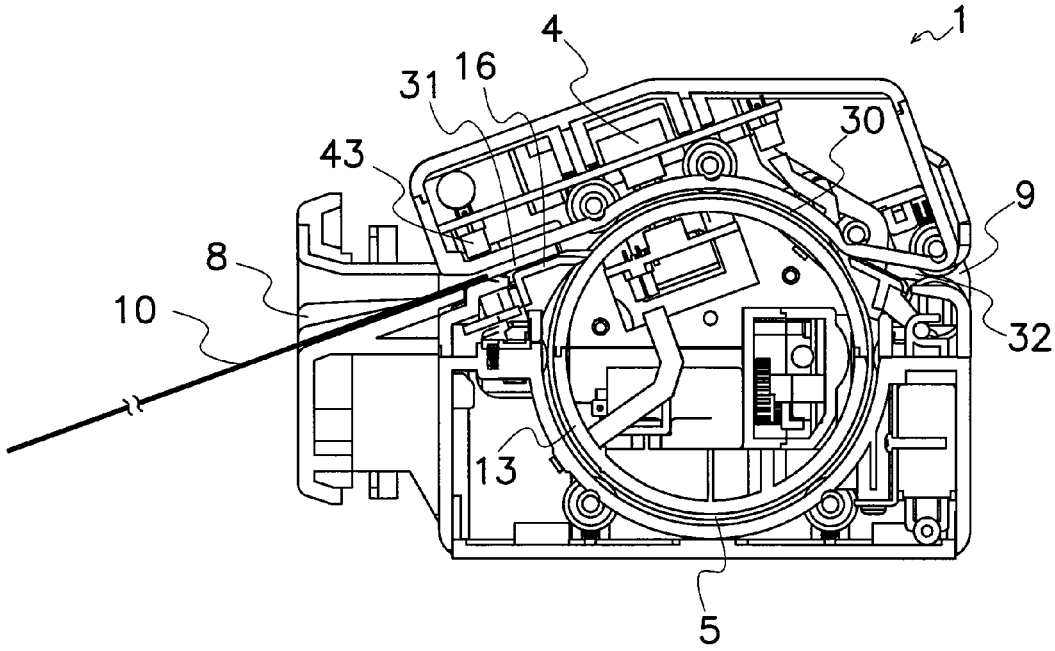
FIG. 16 A sectional view of the device shown in FIG. 1 when a bill is inserted into an inlet.
Figure 17:
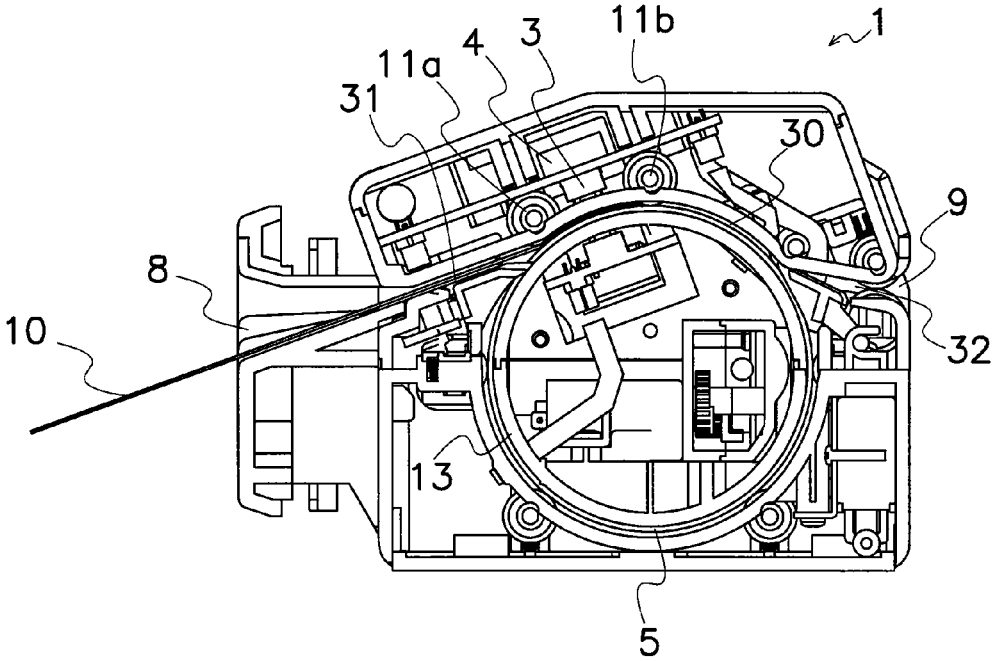
FIG. 17 A sectional view of the device shown in FIG. 1 when a sensor detects the inserted bill.

Bill validating device is operated in accordance with operational sequence shown by a flow chart shown in FIG. 15. When a user inserts a bill 10 into inlet 8 of casing 1 or opening 55 of a faceplate 19 in Step 100, inlet sensor 43 disposed adjacent to inlet 8 in casing 1 detects a tip of bill 10 (Step 101). A detection signal from inlet sensor 43 is forwarded to sensor control circuit 50, and thereby CPU 48 drives motor 21 through motor drive circuit 51 to rotate motor 21 in the forward direction (Step 102). Through intermediate gear 39 and drive shaft 34, motor 21 rotates a pair of pinions 22 which rotate first and second rotors 25 and 26 in synchronized fashion (Step 103). Rotating first and second rotors 25 and 26 are supported by idle pinions 24, and when bill 10 is inserted at the rear of inlet sensor 43 from inlet 8 in casing 1, bill 10 is grasped between rotor arrangements 5 and first pinch roller 11*a*, and conveyed generally linearly inward of casing 1 through entryway 31 toward annular pathway 30. Then, bill 10 is successively conveyed by rotor arrangements 5 and second, third, fourth, fifth, sixth and seventh pinch rollers 11*b*, 11*c*, 11*d*, 11*e*, 11*f* and 11*g* to wind up a whole length of bill 10 around rotor arrangements 5 for their unitary rotation. Then, as shown in FIG. 17, tip of bill 10 is detected by validator sensor 3 which has LED and light receiving transistor disposed on guide surface 14 of upper shell 7 and approximately at a top of drum 13 (Step 104). In accordance with drive signals from sensor control circuit 50, validator sensor 3 successively detects optical or magnetic features from the front to the rear end of bill 10 traveling along annular pathway 30. Detection signals from validator sensor 3 are delivered to sensor control circuit 50 so that CPU 48 compares detected data from bill 10 with data on genuine bill previously stored in memory circuit 49 to determine whether inserted bill 10 is genuine or not (Step 105). In this way, bill validating device can detect physical features of bill 10 by validator sensor 3 while bill 10 is rotated together with rotor arrangements 5 at least one revolution to validate authenticity of bill 10 in control device 4.

Figure 18:
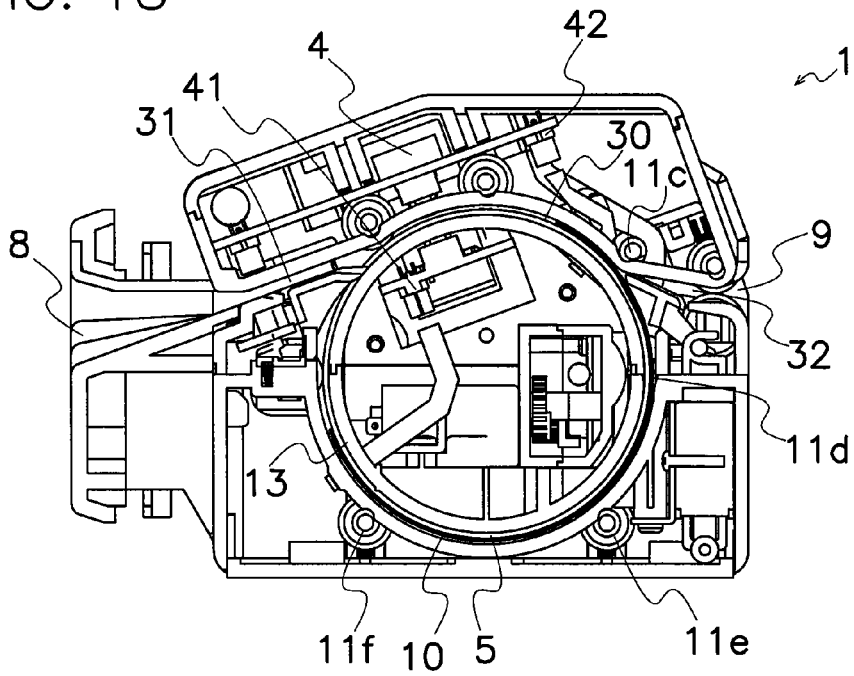
FIG. 18 A sectional view of the device shown in FIG. 1 when the bill passes through an annular pathway.
Figure 19:
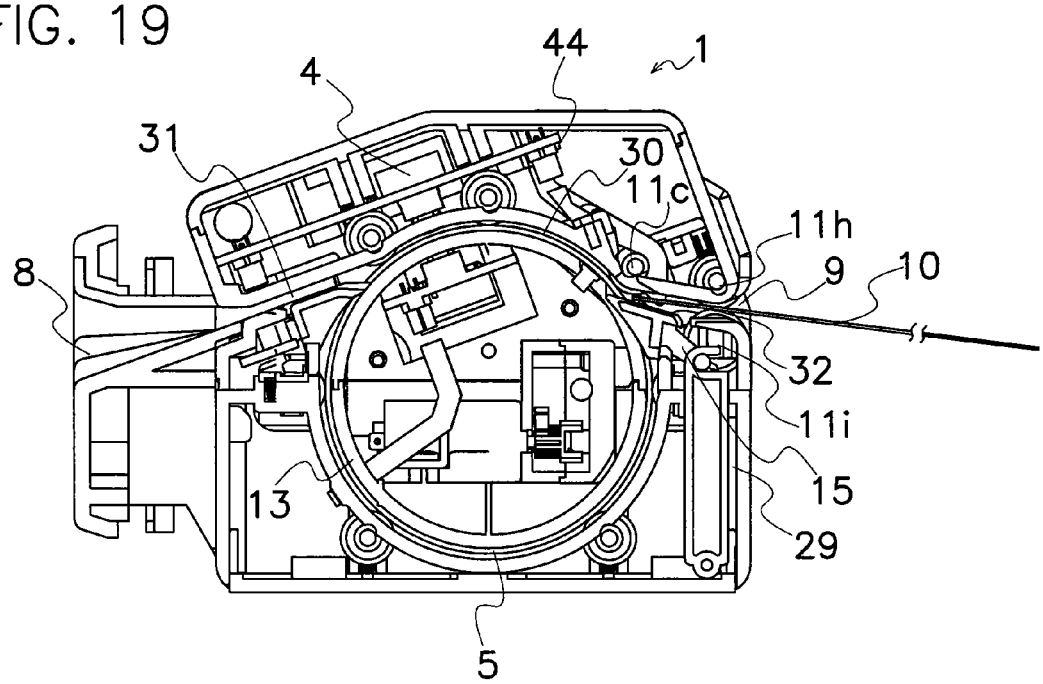
FIG. 19 A sectional view of the device shown in FIG. 1 when the bill is discharged through an outlet.
Figure 20:
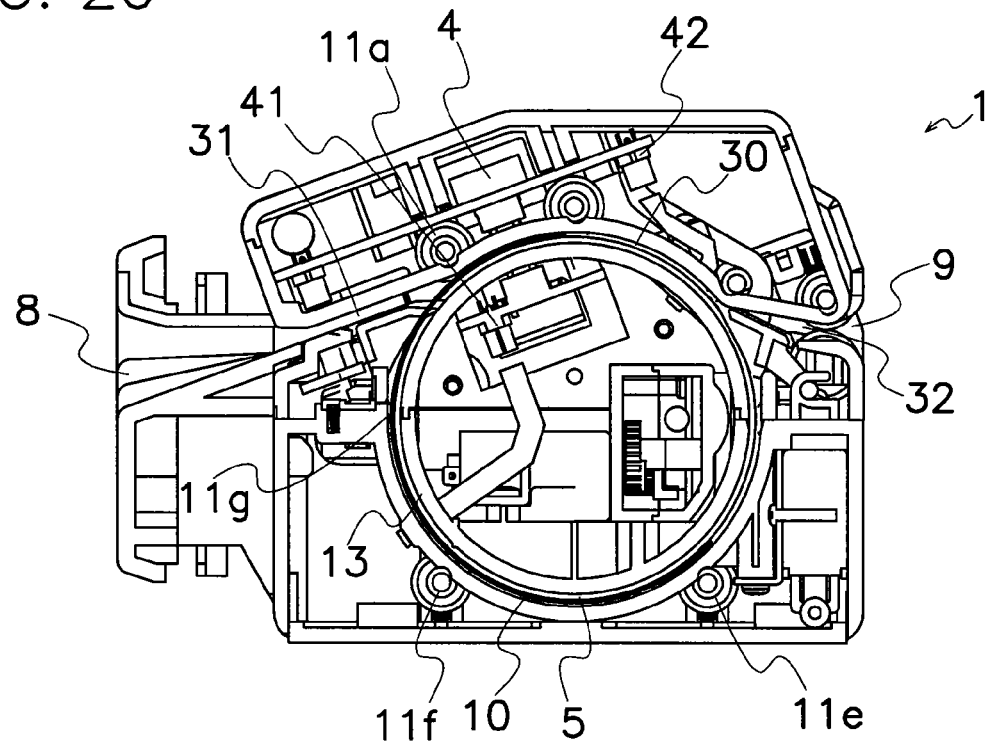
FIG. 20 A sectional view of the device shown in FIG. 1 when the sensor redetects the bill.

When control device 4 considers bill 10 to be genuine in accordance with genuine bill data, control device 4 activates motor 21 to rotate rotor arrangements 5 to transport bill 10 along annular pathway 30 as shown in FIG. 18, thereby passing outlet sensor 42 and jam sensor 41 (Step 106). Accordingly, bill 10 considered genuine turns along annular pathway 30 by an angle 360 degrees, namely one revolution, and then, the tip of bill 10 is returned to upper annular pathway 30, an extension of entryway 31 after it has passed jam sensor 41. Accordingly, bill 10 again passes through validator sensor 3 which does not detect data of bill 10. When jam sensor 41 detects un-jamming of bill 10 and then outlet sensor 42 detects tip end of bill 10 within a given period of time after validator sensor 3 detects bill 10, CPU 48 decides no occurrence of bill jamming. After that, CPU 48 drives solenoid 29 through solenoid drive circuit 52 (Step 107) to shift outlet deflector 15 to the contact position, and thereby, tip end 15*a* of outlet deflector 15 is brought into contact to outer circumferential surfaces of drum 13 and side drums 33. Deflector sensor 44 detects movement of outlet deflector 15 to the contact position (Step 108), and CPU 48 decides normal operation of outlet deflector 15. In this situation, when first and second rotors 25 and 26 and roller arrangements 11 are rotated, as shown in FIG. 19, bill 10 is grasped between eighth and ninth pinch rollers 11*h* and 11*i*, transported along outer surface of outlet deflector 15, and then ejected through outlet 9, leaving first and second rotors 25 and 26.

When bill 10 is discharged through outlet deflector 15 from outlet 9, outlet sensor 42 detects rear end of bill 10 (Step 109) to produce a detection signal to sensor control circuit 50. Then, CPU 48 stops operation of motor 21 through motor drive circuit 51 (Step 110) and turns solenoid 29 off through solenoid drive circuit 52 (Step 111) to return outlet deflector 15 to the separate position. The foregoing operation allows the bill validating device to discharge from outlet 9 the only bill 10 considered genuine (Step 112).

Jam sensor 41 detects jamming of bill 10 in annular pathway 30 to produce jam signal to CPU 4 which stops rotation of first and second rotors 25 and 26 once, and then rotate them in the adverse direction to reverse jammed bill 10 to inlet 8. When jammed bill 10 cannot be returned to inlet 8 despite reverse rotation of first and second rotors 25 and 26, upper shell 7 can be opened as shown in FIG. 5 to remove jammed bill 10 from revealed first and second rotors 25, 26 and drum 13.

The bill validating device according to the present invention can rotate bill 10 together with first and second rotors 25 and 26 in an angular range of 360 degrees or more. Accordingly, even though extraction tool such as a string or tape is connected to bill 10 to improperly try to withdraw bill 10 inside of the device, rotor arrangements 5 absolutely blocks such trial because rotor arrangements 5 have wound up extraction tool around drum 13 or first or second rotor 25, 26 which cannot be rotated in the adverse direction although external force is applied. In this way, rotor arrangements 5 are used to effectively prevent unauthorized withdrawal of bill 10 by extraction tool as well as transport bill 10 while suppressing increase in number of involved parts, rise in cost for manufacture and growth in size and weight. Extraction tool connected to bill 10 is wound around first and second rotors 25 and 26, drum 13 or side drums 33 in an angular range of 360 degrees or more when bill 10 is again detected by validator sensor 3 after Step 107, and simultaneously adverse rotation of first and second rotors 25 and 26 is blocked to prohibit improper pulling out of bill 10 by extraction tool. Existent any sensor 3, 41, 42 and 43 or separate detection sensor may detect presence of extraction tool to activate a warning device not shown. Alternatively, as rotation of first and second rotors 25 and 26 is interrupted by extraction tool, any means can be provided to detect reduction in rotation rate of first and second rotors 25 and 26 to operate a warning device.

Figure 21:
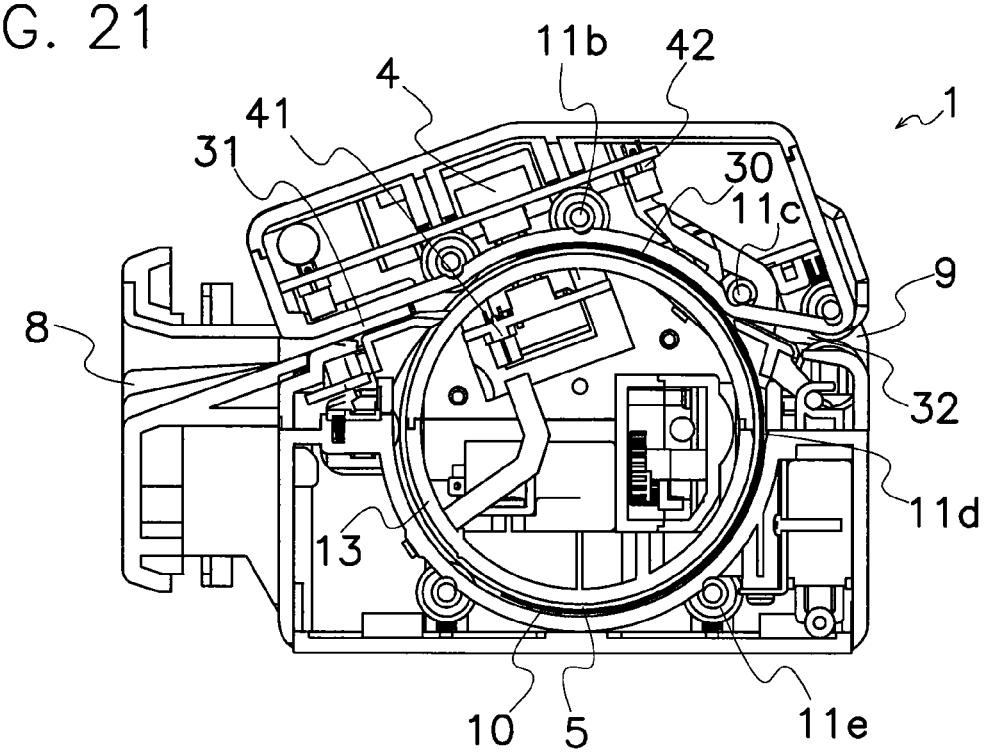
FIG. 21 A sectional view of the device shown in FIG. 1 when rotation of the rotor arrangement is stopped.
Figure 22:
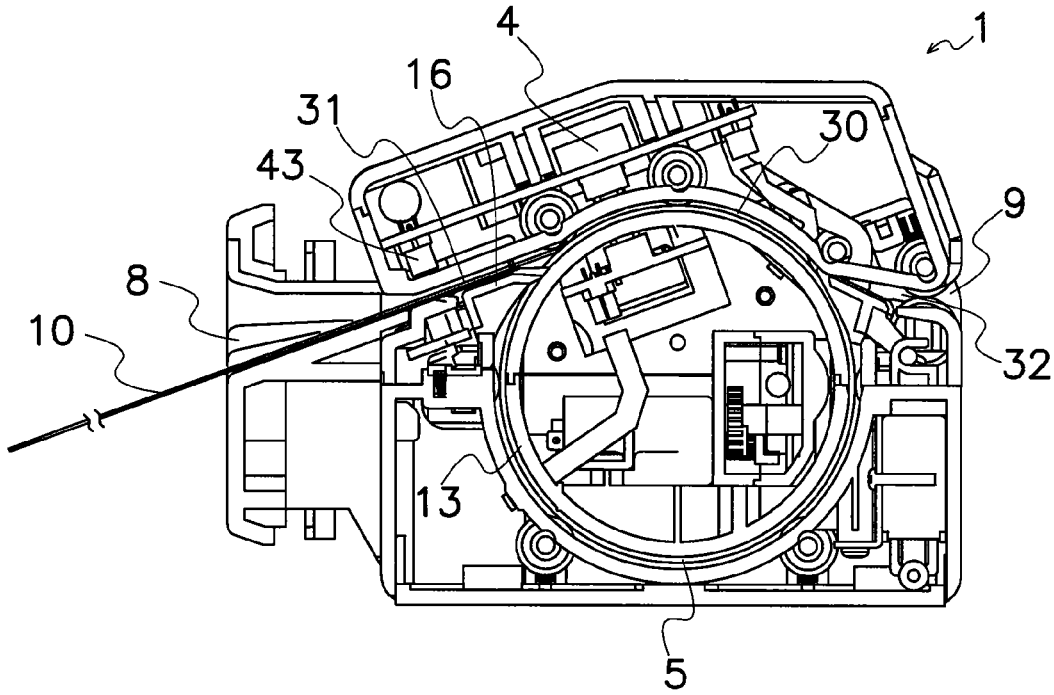
FIG. 22 A sectional view of the device shown in FIG. 1 when the bill is returned to the inlet.

When bill 10 cannot be considered genuine in Step 105 due to disagreement with data on genuine bill, it is successively rotated together with first and second rotors 25 and 26 to again detect optical or magnetic feature of bill 10 by validator sensor 3. Following the first rotation after insertion of bill 10 from inlet 8, bill 10 is secondly rotated in Step 113 and again passes jam sensor 41 (Step 114) as shown in FIG. 18. Then, validator sensor 3 again detects physical feature from front to rear end of moving bill 10 along annular pathway 30, and CPU 48 compares the detected data of bill 10 with data of genuine bill in memory circuit 49 to determine whether moving bill 10 is genuine or not (Step 116). Bill 10 considered genuine in Step 116 moves on to Step 106 and is discharged through outlet deflector 15 and outlet 9 of casing 1, however, bill 10 considered not genuine is returned to Step 113 only when the number of rotation for validation does not reach predetermined n times (Step 117) so that validator sensor 3 again detects optical or magnetic feature of bill 10 (Steps 114 to 116). Predetermined n times are for example three times, and in that case, when bill 10 cannot be considered genuine even after repetition of operation in Steps 113 to 116 twice, CPU 48 provides motor drive circuit 51 with a stop signal to pause rotation of motor 21 as shown in FIG. 21, and then reversely rotate motor 21 (Step 118). Motor 21 rotates first and second rotors 25 and 26 in the adverse direction (Step 119) to return bill 10 outside of faceplate 19 through return deflector 16 and inlet 8 of casing 1.

When validator sensor 3 detects optical feature of bill 10, in some cases, validator sensor 3 may confront failure of detecting genuine bill due to wrinkles in bill, and even in case of redetection by validator sensor 3 after detection failure, processing moves on to operations in Steps 105 through 113 to repetitively try to detect physical feature of bill 10. Specifically, the bill validating device according to the present invention can rotate bill 10 along with first and second rotors 25 and 26 more than once to successively iteratively validate the bill even when control device 4 cannot completely validate bill 10 based on physical feature thereof validator sensor 3 detects during rotation of bill 10 on first and second rotors 25 and 26. In this case, the device does not need reverse rotation of conveying device as in prior art devices to return bill to inlet for iterative validation, and therefore, there would be no case that a user accidentally pulls out bill 10 returned to inlet 8. When the number of rotation for validation reaches predetermined n times in Step 117, for example three times, processing moves on to Steps 118 and 119 where bill 10 is returned to inlet 8 by reverse rotation of motor 21 and rotors 25 and 26. When inlet sensor 43 detects returned bill 10 in Step 120, CPU 48 receives detection signal from inlet sensor 43 to stop operation of motor 21 through motor drive circuit 51 when rear end of bill 10 sufficiently protrudes from inlet 8 for easy takeout of bill 10 by user.

Figure 23:
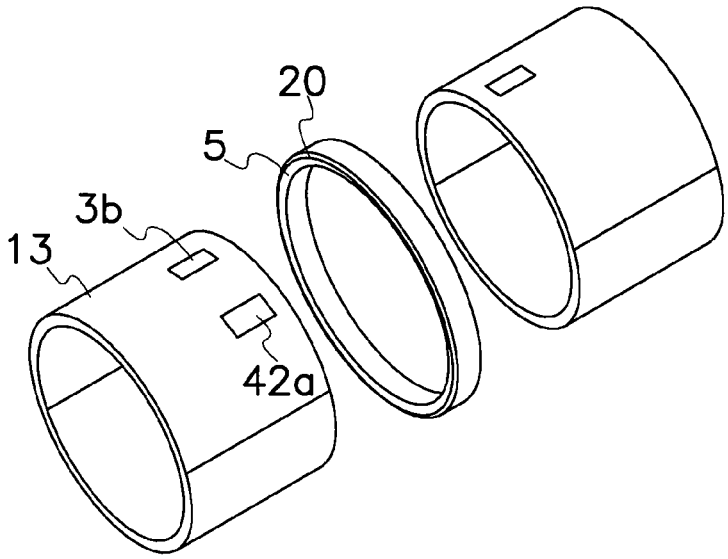
FIG. 23 An exploded perspective view showing another embodiment of the rotor arrangement and drum.
Figure 24:
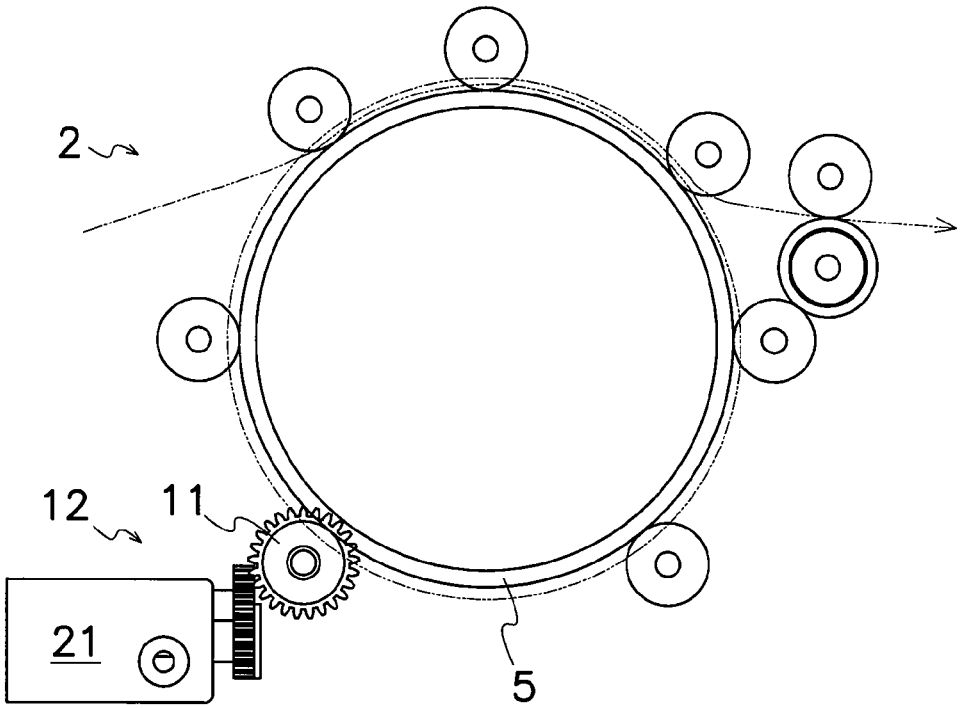
FIG. 24 A sectional view showing another embodiment of the conveying device.
Figure 25:
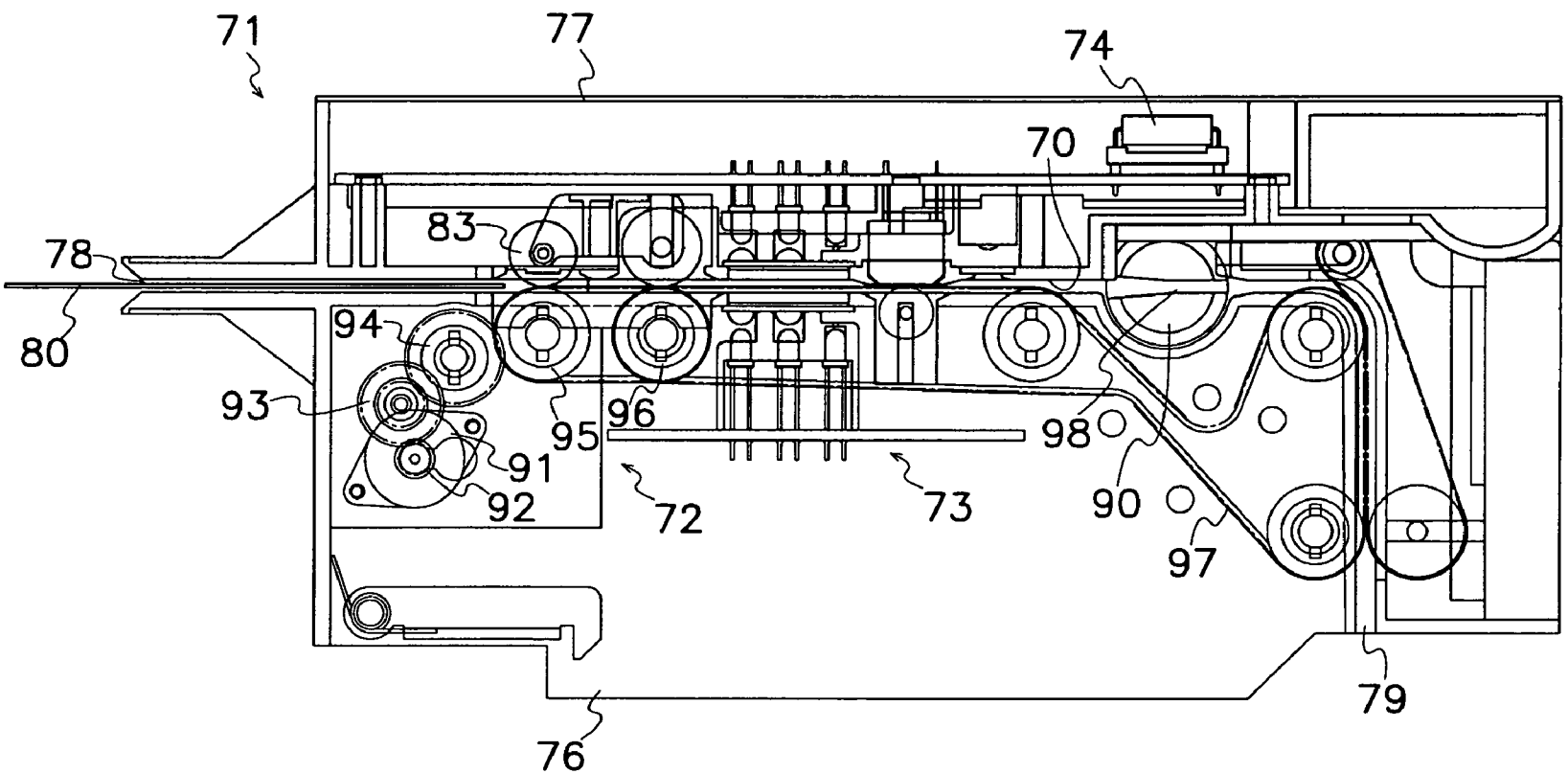
FIG. 25 Prior Art
FIG. 25 A sectional view of a prior art bill validating device.
Figure 26:
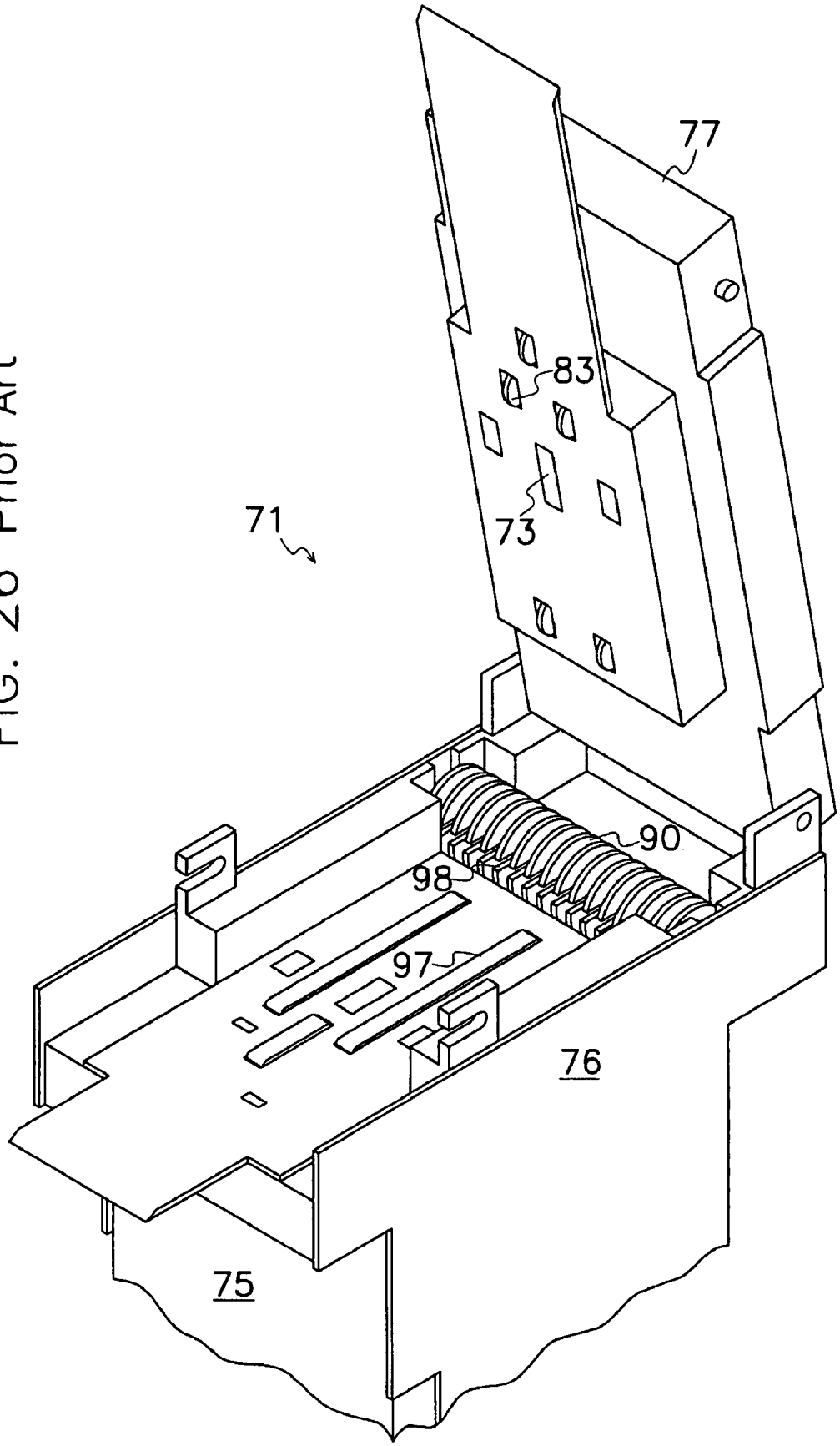
FIG. 26 Prior Art
FIG. 26 A perspective view of the device shown in FIG. 25.

The foregoing embodiments of the present invention may be varied in various ways. For example, as shown in FIG. 23, the device may utilize a single rotor arrangement 5 arranged between a pair of drums 13. Although not shown, but three or more rotor arrangements 5 may be provided. First and second rotors 25, 26, drum 13 and drive device 12 disposed within them can be detached from inside of lower shell 6 to easily remove jammed bill 10 in annular pathway 30 and replace degraded or troubled parts such as coating layer 20 or first or second rotor 25, 26 with new ones. Also, the present invention contemplates drive device 12 which may comprise one or more of pinch rollers 11*a* to 11*g* drivingly connected to motor 21 and rotor arrangements 5 to rotate rotor arrangements 5. In lieu of idle pinions 24, rotor arrangements 5 may be supported by plural pinch rollers 11*a* to 11*g* arranged around rotor arrangements 5. Inlet 8 and outlet 9 of casing 1 may be provided in another changed location as required, for example, outlet 9 may be formed at the bottom of casing 1 to stow bill 10 discharged from outlet 9 into a stacker attached to the bottom of casing 1.

The bill validating device according to the present invention has the following functions and effects:

[1] The device can wind up whole length of bill 10 inserted from inlet 8 of casing 1 around outer circumferential surface of rotating rotor arrangements 5 in the sandwiched condition of bill 10 between rotor arrangements 5 and roller arrangements 11 to smoothly convey bill 10 with rotation of rotor arrangements 5.

[2] Bill 10 is firmly grasped between rotor arrangements 5 and roller arrangements 11 to ensure transportation of bill 10 while preventing slippage bill 10 on rotor arrangements 5.

[3] The device can absolutely prevent unauthorized extraction of bill 10 because rotor arrangements 5 can provide a rotating unitary construction with bill 10 winding therearound at least one revolution to wind up extraction tool during rotation. Bill 10 however can then be separated from rotor arrangements 5 and dispatched through outlet 9.

[4] The device does not need convey belts for transporting bill 10, and therefore, enables cut-down in transported distance of bill 10, reduction in the number of parts in the driving system, manufacture of the device smaller in size and lighter in weight and easier assemblage of the device.

[5] Rotor arrangement 5 can produce a strong grasping force of bill 10 in collaboration with roller arrangement 11 without elastic deformation of rotor arrangements 5 to reliably transport bill 10 wound around rotor arrangements 5 with jamming-proof during transportation.

[6] The device can successively validate bill 10 more than once by rotating, in the same direction, bill 10 together with rotor arrangements 5 necessary several times for detection of physical feature of bill 10 even though the device cannot completely validate bill 10.

[7] In this case, there is no need of adverse rotation of conveying device to temporarily return bill 10 to inlet 8.

UTILIZATION IN INDUSTRY

The device for validating valuable papers according to the present invention is applicable to discriminate other valuable documents such as credits, certificates, coupons, scrip, bank notes and tickets without limitation to bills.

What is claimed is:

1. A device for validating valuable papers comprising:

a casing formed with an inlet and an outlet, said casing having an arcuate member, a drum secured within said casing, a conveying device that comprises:

a rotor arrangement rotatably mounted in said casing in the vicinity of the drum to form an annular pathway in an angular range of 360 degrees between said rotor arrangement and said arcuate member, a roller arrangement in contact to an outer surface of said rotor arrangement to grasp a valuable paper inserted from the inlet between said rotor arrangement and said roller arrangement, and rotate said paper together with said rotor arrangement at least one revolution along said annular pathway so that a whole length of said paper is wound around the outer surface of said rotor arrangement, and a drive device for rotating said rotor arrangement, a sensor arranged along said annular pathway for detecting a physical property of a valuable paper moved along said annular pathway to produce detection signals, and a control device for validating authenticity of the paper in view of detection signals from said sensor to control operation of said conveying device so that said paper is separated from said annular pathway and discharged through said outlet, when said control device considers the paper to be genuine based on the detection signals from said sensor, wherein the paper is validated more than once based on detection signals from said sensor during the continuous rotation in the same direction of said rotor arrangement around which the paper is wound.

2. The device of claim 1, wherein the whole circumferential length of said rotor arrangement is longer than the whole length of said paper.

3. The device of claim 1, wherein said rotor arrangement has an anti-skid coating layer formed on an outer circumferential surface of said rotor arrangement.

4. The device of claim 1, wherein at least three pinch rollers are arranged around and in contact to said rotor arrangement.

5. The device of claim 1, wherein said drive device comprises a motor, and power transmission means for drivingly connecting one or both of said rotor arrangement and roller arrangement to said motor, said power transmission means comprising an anti-pull back device for preventing rotation of said rotor arrangement or roller arrangement when an external force is applied thereto.

6. The device of claim 5, wherein said power transmission means comprises a pinion rotated by said motor, and an internal gear formed in said rotor arrangement for driving engagement with said pinion.

7. The device of claim 6, wherein a plurality of idle pinions are deployed inside of said rotor arrangement for interlocking with said internal gear to rotatably support said rotor arrangement.

8. The device of claim 6, wherein said internal gear is integrally formed with said rotor arrangement.

9. The device of claim 1, wherein said drum has a diameter slightly smaller than that of said rotor arrangement.

10. The device of claim 6, wherein said motor and pinion are disposed within said drum.

11. The device of claim 1, wherein said casing comprises a lower shell and an upper shell rotatably connected to said lower shell, said upper shell comprises a guide surface which has an arcuate shape complementary to a part of a cylindrical surface in said rotor arrangement, first and second parts of said sensor are separately attached to the guide surface in said upper shell and the drum.

12. The device of claim 1, further comprising an outlet deflector movable between a separate position away from said drum and a contact position to an outer surface of said drum, wherein a unitary construction of said rotor arrangement and the paper passes inside of said outlet deflector during rotation of said rotor arrangement when the paper is wound around the rotor arrangement and said outlet deflector is in the separate position, the paper is discharged along said outlet deflector away from said rotor arrangement through said outlet when said outlet deflector is in the contact position.

13. The device of claim 1, further comprising a return deflector which is brought into contact to said drum by its own weight or elastic force of a spring, wherein the paper wound around said rotor arrangement is rotated for transportation while said paper overrides said return deflector which is forcibly moved outward against its own weight or elastic force of the spring, when said rotor arrangement is rotated in the adverse direction, the paper wound around said rotor arrangement is returned to said inlet along said return deflector away from said rotor arrangement.

14. The device of claim 1, further comprising a pair of circular side walls in said casing axially outward of said rotor arrangement.

15. The device of claim 11, wherein said arcuate member is provided in said lower shell in radially spaced relation to said rotor arrangement to define said annular pathway between said rotor arrangement and arcuate member and between said rotor arrangement and guide surface of the upper shell to transport the paper through said annular pathway.

16. The device of claim 15, further comprising an entryway extending from the inlet and connected to said annular pathway in the tangential direction, and an exit way extending to the outlet and connected to said annular pathway in the tangential direction.

17. The device of claim 1, wherein said rotor arrangement comprises first and second rotors disposed in perpendicularly spaced relation to each other to the transported direction of the paper, said roller arrangement has first and second sets of pinch rollers, said first sets of pinch rollers include a plurality of pinch rollers disposed around and in contact to an outer circumferential surface of said first rotor, said second sets of pinch rollers include a plurality of pinch rollers disposed around and in contact to an outer circumferential surface of said second rotor.

18. The device of claim 17, wherein said drive device comprises a motor, a pair of pinions rotatably mounted on a drive shaft rotated by said motor, and each of said first and second rotors comprises an internal gear meshed with each of said pinions.

19. The device of claim 17, wherein said drum is disposed between said first and second rotors.

20. A device for validating valuable papers comprising:

a casing formed with an inlet and an outlet, said casing having an arcuate member, a conveying device that comprises:

a rotor arrangement rotatably mounted in said casing to form an annular pathway in an angular range of 360 degrees between said rotor arrangement and said arcuate member, said rotor arrangement comprising first and second rotors disposed in spaced relation to each other in the axial direction, a roller arrangement which has first sets of pinch rollers each disposed around and in contact to an outer circumferential surface of said first rotor, and second sets of pinch rollers each disposed around and in contact to an outer circumferential surface of said second rotor to grasp opposite sides of a valuable paper inserted from the inlet between said first and second rotors and said first and second sets of pinch rollers, and rotate said paper together with said first and second rotors at least one revolution along said annular pathway so that a whole length of said paper is wound around each outer surface of said first and second rotors, and a drive device for synchronously rotating said first and second rotors, a drum secured within said casing between said first and second rotors, a sensor arranged along said annular pathway for detecting a physical property of a valuable paper moved along said annular pathway to produce detection signals, and a control device for validating authenticity of the paper in view of detection signals from said sensor to control operation of said conveying device so that said paper is separated from said annular pathway and discharged through said outlet when said control device considers the paper to be genuine based on the detection signals from said sensor.

21. The device of claim 20, wherein each whole circumferential length of said first and second rotors is longer than the whole length of said paper.

22. The device of claim 20, wherein each of said first and second rotors has an anti-skid coating layer formed on an outer circumferential surface of said first and second rotors.

23. The device of claim 20, wherein said drive device comprises a motor, and power transmission means for drivingly connecting said motor and at least one or both of said first and second rotors and first and second sets of pinch rollers, said power transmission means comprises an anti-pull back device for preventing rotation of said first and second rotors or first and second sets of pinch rollers when an external force is applied thereto.

24. The device of claim 23, wherein said power transmission means comprises a pinion rotated by said motor, and an internal gear formed in each of said first and second rotors for driving engagement with said pinion.

25. The device of claim 24, wherein a plurality of idle pinions are deployed inside of said first and second rotors so that each of said idle pinions is interlocked with said internal gear to rotatably support said first and second rotors.

26. The device of claim 24, wherein said internal gear is integrally formed with said first and second rotors.

27. The device of claim 24, wherein said motor and pinion are disposed within said first and second rotors and drum.

28. The device of claim 20, wherein said drum has a diameter slightly smaller than that of said first and second rotors.

29. The device of claim 20, wherein said casing comprises a lower shell and an upper shell rotatably connected to said lower shell to open said upper shell, said upper shell comprises a guide surface which has an arcuate shape complementary to a part of a cylindrical surface in said first and second rotors, first and second parts of said sensor are separately attached to the guide surface in said upper shell and the drum.

30. The device of claim 20, further comprising an outlet deflector movable between a separate position away from said drum and a contact position to an outer surfaces of said drum, wherein a unitary construction of said first and second rotors and the paper passes inside of said outlet deflector during rotation of said rotor arrangement when the paper is wound around the rotor arrangement and said outlet deflector is in the separate position, the paper is discharged along said outlet deflector away from said first and second rotors through said outlet when said outlet deflector is in the contact position.

31. The device of claim 20, further comprising a return deflector which is brought into contact to said drum by its own weight or elastic force of a spring, wherein the paper is wound around said first and second rotors for rotating transportation while said paper overrides said return deflector which is forcibly moved outward against its weight or elastic force of the spring, when said first and second rotors are rotated in the adverse direction, the paper is wound around said first and second rotors to be returned to said inlet along said return deflector away from said first and second rotors.

32. The device of claim 20, further comprising a pair of circular side walls in said casing axially outward of said first and second rotors.

33. The device of claim 29, wherein said arcuate member is provided in said lower shell in radially spaced relation to said first and second rotors to define said annular pathway between said first and second rotors and arcuate member and between said first and second rotors and guide surface of the upper shell to transport the paper through said annular pathway.

34. The device of claim 33, further comprising an entryway extending from the inlet and connected to said annular pathway in the tangential direction, and an exit way extending to the outlet and connected to said annular pathway in the tangential direction.

35. The device of claim 20, wherein said drive device comprises a motor, a pair of pinions rotatably mounted on a drive shaft rotated by said motor, and each of said first and second rotors comprises an internal gear meshed with each of said pinions.

* * * * *